US008780037B2

(12) United States Patent
Murakami et al.

(10) Patent No.: US 8,780,037 B2
(45) Date of Patent: Jul. 15, 2014

(54) DISPLAY METHOD AND DISPLAY DEVICE

(75) Inventors: Hirofumi Murakami, Osaka (JP); Kohji Fujiwara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 196 days.

(21) Appl. No.: 13/383,492

(22) PCT Filed: Apr. 20, 2010

(86) PCT No.: PCT/JP2010/057021
§ 371 (c)(1),
(2), (4) Date: Jan. 11, 2012

(87) PCT Pub. No.: WO2011/040075
PCT Pub. Date: Apr. 7, 2011

(65) Prior Publication Data

US 2012/0113166 A1 May 10, 2012

(30) Foreign Application Priority Data

Sep. 30, 2009 (JP) ..... 2009-227528

(51) Int. Cl.
*G09G 3/36* (2006.01)

(52) U.S. Cl.
USPC ..... 345/102; 345/690; 362/97.2

(58) Field of Classification Search
USPC ..... 345/87, 102, 204, 690; 313/498; 362/97.1–97.3; 349/69, 70
See application file for complete search history.

(56) References Cited

U.S. PATENT DOCUMENTS

| | | | | |
|---|---|---|---|---|
| 6,377,237 | B1 * | 4/2002 | Sojourner | 345/102 |
| 7,405,741 | B1 * | 7/2008 | Zhang et al. | 345/690 |
| 2001/0038369 | A1 | 11/2001 | Adachi et al. | |
| 2006/0007103 | A1 | 1/2006 | Oh et al. | |
| 2007/0063940 | A1 * | 3/2007 | Juenger | 345/87 |
| 2008/0238863 | A1 * | 10/2008 | Nishigaki | 345/102 |
| 2009/0091524 | A1 | 4/2009 | Lomas | |
| 2009/0167673 | A1 | 7/2009 | Kerofsky | |
| 2010/0328535 | A1 | 12/2010 | Okui et al. | |
| 2011/0267383 | A1 | 11/2011 | Murakami et al. | |

FOREIGN PATENT DOCUMENTS

| | | | | |
|---|---|---|---|---|
| CN | 101467201 | A | 6/2009 | |
| JP | 2001-343956 | A | 12/2001 | |
| JP | 2004-163829 | * | 6/2004 | G09G 3/36 |

(Continued)

OTHER PUBLICATIONS

International Search Report and Written Opinion of Searching Authority, Jun. 2010.

*Primary Examiner* — Tom Sheng
(74) *Attorney, Agent, or Firm* — Harness, Dickey & Pierce

(57) ABSTRACT

A display method of an embodiment (i) determines a suitable length of an off period of an LED in accordance with a gray scale transition time, i.e., a time during which a transmittance of a liquid crystal is being changed, and (ii) turns off a light source for the determined length of the off period in a first half part of a one frame period. This makes it difficult for a half-way change in a gray scale transition to be reflected in a brightness of a pixel. Also, by performing a gray scale transition emphasis process to a display signal when the gray scale transition is caused, it is possible to increase the brightness of the pixel in the midst of the gray scale transition and to reduce a response time of the pixel. As such, it is possible to further improve a quality of moving image display.

11 Claims, 12 Drawing Sheets

(56) References Cited

FOREIGN PATENT DOCUMENTS

| | | | |
|---|---|---|---|
| JP | 2004163829 | A | 6/2004 |
| JP | 2004309592 | A | 11/2004 |
| JP | 2005-310996 | A | 11/2005 |
| JP | 2005338857 | A | 12/2005 |
| JP | 2005352026 | A | 12/2005 |
| JP | 2009157378 | A | 7/2009 |
| WO | WO-2009096329 | A1 | 8/2009 |
| WO | WO-2010134235 | A1 | 11/2010 |

* cited by examiner

Prior Art

Prior Art

DISPLAY METHOD AND DISPLAY DEVICE

TECHNICAL FIELD

The present invention relates to a display method that performs a display operation while turning on and off a light source of a display device to blink in synchronization with, for example, a frame frequency of a display signal. The present invention also relates to a display device that practices the display method.

BACKGROUND ART

As display devices, the following display devices have been conventionally known: an impulse-type display device such as CRT (cathode-ray tube), for example, and a hold-type display device such as a liquid crystal display device, for example.

In the impulse-type display device, a lighting period during which an image is displayed and a blanking period during which no image is displayed are repeatedly alternated in each pixel. Thus, even in a case where a moving image is displayed, for example, a viewer rarely views an image blurring of a moving object in the moving image. This is because the blanking period is inserted at timing when an image corresponding to one screen is rewritten. Therefore, the viewer can distinguish the moving object from a background and view the moving image without experiencing discomfort.

On the other hand, in the hold-type display device, a brightness of each pixel is maintained during a one frame period (one vertical period) during which an image corresponding to a one screen is rewritten. In the hold-type display device, in a case where a moving image is displayed, a viewer views an image blurring of a moving object in the moving image. Specifically, the viewer views blurring of a contour of the moving object. Such a phenomenon is called a moving image blurring (pseudo contour), and it is thought that the image blurring is caused due to the following (i) and (ii): (i) incapability of a display condition of the pixel to instantaneously respond to a gray scale transition and (ii) viewer's visual tracking of the moving object.

Because the hold-type display device has a drawback that such a moving image blurring is caused in a moving image display, the impulse-type display device has been long employed in a display such as a television to perform a moving image display.

It has been recently strongly demanded that the display such as a television be thin in thickness and light in weight. In such a circumstance, the hold-type display device, which is easy to be thin in thickness and light in weight, has been increasingly employed to such a display.

A liquid crystal display device, in particular, has features of a reduced thickness, a light weight, and a low power consumption. The liquid crystal display device has been recently widely used, replacing CRT, in various fields such as a television, a monitor, a mobile device such as a mobile phone, and the like.

However, the liquid crystal display device is generally very inferior to other display devices such as CRT in terms of a response speed to a display signal. In the liquid crystal display device, a display gray scale is changed by causing a change in a voltage applied to a liquid crystal layer of the pixel that forms a display screen, and thereby causing a change in an alignment condition of liquid crystal molecules so as to cause a change in a transmittance of the pixel. In the liquid crystal display device, a response speed of the pixel is equal to an inverse of a time (response time) required for the alignment condition of the liquid crystal layer to reach an alignment condition corresponding to an applied voltage.

However, it takes a certain amount of time before the alignment condition of the liquid crystal layer to reach the alignment condition corresponding to the applied voltage. In a liquid crystal panel compatible with a frame frequency of 120 Hz per second, for example, it is intended that rewriting in each pixel is performed 120 times per second. However, there may be a case that it takes two or more frame to cause a response in the pixel.

This may cause a problem that a desired display gray scale cannot be realized in a recent liquid crystal display device with a large screen or a high definition display. This is because, in this liquid crystal display device, a driving time (writing time) of each pixel is so short that the writing time may not be long enough to fully cause a change in an alignment condition of a liquid crystal molecule in response to a change in an applied voltage.

A driving method called overshoot driving (overdriving), which is a driving method (tone transition emphasis process) of a liquid crystal display device, has been recently proposed as a technique of improving a response speed of a liquid crystal (see the patent literature 1, for example).

The tone transition emphasis process is a driving process that (i) applies an exaggerated voltage to a pixel in response to a gray scale transition, so as to speed up a response of a liquid crystal of the pixel, and thereby (ii) improves a response speed of the pixel.

Specifically, in a case where a gray scale is changed from a gray scale A to a gray scale B greater than the gray scale A, a voltage greater than a writing voltage for the gray scale B is applied to a pixel during a predetermined period. After this, the targeted writing voltage for the gray scale B is applied to the pixel. This speeds up a change in alignment of liquid crystal molecules, and thereby causes a increase in the response speed of the liquid crystal. As such, it is possible to further speed up the response speed of the pixel for the gray scale transition from the gray scale A to the gray scale B.

In contrast to the above case, in a case where the gray scale is changed from the gray scale A to a gray scale C less than the gray scale A, a voltage less than a writing voltage for the gray scale C is applied to the pixel during a predetermined period. This can bring about an effect similar to the effect obtained in the above case.

CITATION LIST

Patent Literature

Patent Literature 1

Japanese Patent Application Publication, Tokukai, No. 2001-343956 A (Publication Date: Dec. 14, 2001)

Patent Literature 2

Japanese Patent Application Publication, Tokukai, No. 2005-310996 A (Publication Date: Nov. 4, 2005)

Patent Literature 3

Japanese Patent Application Publication, Tokukai, No. 2005-338857 A (Publication Date: Dec. 8, 2005)

SUMMARY OF INVENTION

Technical Problem

However, a liquid crystal display device has a problem that a response speed of a liquid crystal is slow. Furthermore, a driving manner of the liquid crystal display device is of a hold-type driving, as described earlier. This gives a rise to another problem that a moving image display suffers moving image blurring. The moving image blurring is caused in a case where a response speed in a pixel is slow. This is because an intermediate gray scale between gray scales A and B is viewed within a gray scale transition from the gray scale A to the gray scale B.

In order to prevent the image blurring in the moving image display, it is optional to employ the following countermeasures (i) and (ii): (i) lighting as least as possible a backlight which serves as a light source of the liquid crystal display device, and (ii) having a blanking period during which a black display is inserted to the moving image display, as in the aforementioned impulse-type display device. In this case, it is necessary to employ an arrangement that blinks the backlight in synchronization with driving of the pixel.

FIG. 12 shows an example of an arrangement enabling blink driving of the backlight, in accordance with the aforementioned patent literature 2.

As shown in FIG. 12, a light source device 40 includes (i) a plurality of LEDs 41 connected in series with each other, (ii) switches 42 connected in parallel with the respective plurality of LEDs 41, (iii) a switch control circuit 43 for controlling "on" and "off" of each of the switches 42 independently from each other, and (iv) a driving control circuit 44 for constant-current driving the plurality of LEDs 41.

When the switch control circuit 43 switches on a given switch 42 while the plurality of LEDs 41 are being constant-current driven, no current flows into that one of the plurality of LEDs 41 which is connected in parallel with the given switch 42. This is because a closure of the given switch 42 causes a current to bypass this LED 41.

As understood from this, an LED 41 is turned on when a corresponding switch 42 is in an "off" condition and turned off when the corresponding switch 42 is in an "on" condition.

However, the switch control circuit 43 lacks an arrangement that adjust timings at which the switch 42 is switched between the "on" and "off" conditions. On this account, synchronizing the "on" and "off" conditions of the switch 42 with pixel driving alone cannot enable inserting as appropriate a black in a one frame period of a moving image display. As such, it is impossible to prevent the moving image blurring. This is described in detail below, with reference to FIG. 13.

FIG. 13 is a timing chart showing how an image is actually viewed on a liquid crystal display (LCD) device, in a condition that a waveform of an input and an output of each signal, a waveform of a transmittance of liquid crystal, a waveform of a value obtained by integrating a product of multiplication of the transmittance of liquid crystal and a lighting intensity of a backlight by a lighting time (in FIG. 13, a product of multiplication of a lighting intensity of the backlight and the transmittance of liquid crystal) are adjusted to each other in timing.

Assume that an LCD video signal corresponding to a given a pixel is changed from a low gray scale to a high gray scale in a frame which is, for convenience, labeled with a frame number 3 (see (a) and (g) of FIG. 13). In this case, an LCD driving signal created based on the LCD video signal (see (b) of FIG. 13) is applied to the given pixel. This causes a liquid crystal in the given pixel to have a change in transmittance at a response speed corresponding to the gray scale transition (see (c) of FIG. 13).

On the other hand, a backlight lighting signal, which switches the backlight between the "on" and "off" conditions, is created so that the "on" condition of the backlight is started in synchronization with a start of each frame and lasts for a predetermined period in each one frame period (see (d) of FIG. 13).

In a case where the above backlight lighting signal is supplied, a brightness of a pixel is changed similarly to how the transmittance of the liquid crystal in the pixel is changed during the first half part of the frame 3 (see (e) of FIG. 13). This is because a brightness of the pixel is equal to an integration value found by integrating a product of multiplication of a transmittance of a liquid crystal and a lighting intensity of the backlight by a lighting time of the backlight. As a result, a viewer views an intermediate gray scale which is not originally intended (see (f) of FIG. 13). This results in the problem that the moving image blurring is caused.

Response speeds of liquid crystals are not constant, because they are varied in accordance with a combination of a gray scale before a gray scale transition and a gray scale after the gray scale transition. The slower the response speeds of the liquid crystals are to the gray scale transition, the more noticeable the moving image blurring is.

The present invention is made in view of the problem, and an object of the invention is to provide a display method and a display device each being capable of reducing image blurring by setting, in response to a gray scale transition in a display signal, a blanking period of a light source of the display device within a one frame period of the display signal as appropriate in accordance with a response speed (response time) of a pixel.

Solution to Problem

In order to attain the object, a display method of the present invention, which (i) causes pixels forming a display screen to display information, by driving the pixels in accordance with a display signal so as to modulate, via each pixel, intensity of light emitted from a light source and (ii) blinks the light source in accordance with a frame frequency, includes the steps of: finding an average of a response time required for each pixel belonging to a specific area of the display screen to respond to a gray scale transition between a frame and an adjacent frame following the frame; determining, based on the average of response times in the specific area, at least one of a length of an on period of the light source in a first half part of a one frame and a length of an off period of the light source in a second half part in the one frame; and after the gray scale transition, driving, at least in the adjacent frame in which the gray scale transition is caused, the light source in accordance with the off period or the on period determined in length.

With the arrangement, the number of pixels of each specific area of the display screen is two or more, and each light source emits light toward two or more pixels of each specific area of the display screen. Gray scales in the respective two or more pixels of each specific area may take various values in accordance with an image that will be displayed, and may be changed every frame in a moving image display.

A response time in each pixel, which is required for the pixel to respond to a gray scale transition between the frame and the adjacent frame, is not constant because it is varied in accordance with a change in a combination of a gray scale before the gray scale transition and a gray scale after the gray scale transition. In view of this, the display method of the present invention finds the average of the response times required for the respective plurality of pixels to respond to the respective gray scale transitions caused in the respective plurality of pixels.

After this, the display method of the present invention determines at least one of (i) the length of the off period of each light source in the first half part of the one frame and (ii) the length of the on period of each light source in the second half part of the one frame. After this, the display method of the present invention drives, at least in the adjacent frame in which the gray scale transition is caused, each light source in accordance with the on period or the off period of the light source thus determined.

On this account, the on period or the off period of each light source is adjusted as appropriate in accordance with the various gray scale transitions caused in the respective pixels of each specific area. That is, as for a gray scale transition for which the average of the response times is long, the off period in the first half part of the one frame is extended so as to remove as much as possible an adverse effect that halfway changes in the gray scale transitions are reflected in brightnesses of the respective pixels of each specific area.

The display method of the present invention thus can reduce the moving imaging blurring caused in the moving image display.

In order to attain the object, a display method of the present invention, which (i) causes pixels forming a display screen to display information, by driving the pixels in accordance with a display signal so as to modulate, via each pixel, intensity of light emitted from a light source and (ii) blinks the light source in accordance with a frame frequency, includes the steps of: creating, selectively for a pixel out of pixels belonging to a specific area of the display screen in which pixel a gray scale transition is caused between a frame and an adjacent frame following the frame, an emphasis display signal by performing a gray scale transition process with respect to a display signal in the adjacent frame in which the gray scale transition is caused; finding an average of a response time required for each of pixels belonging to a specific area of the display screen to respond, in a condition that the gray scale transition process has been selectively carried out to the gray scale; determining at least one of a length of an off period of the light source in a first half part of a one frame and a length of an on period of the light source in a second half part of the one frame; and after the gray scale transition, driving, at least in the adjacent frame in which the gray scale is caused, in accordance with the on period or the off period thus determined in length.

The display method of the present invention is different from the display method of the present invention described earlier in terms that the average of response times in the pixels of the specific area is found in condition that the gray scale transition emphasis process has been carried out to the display signal in the adjacent frame in which the gray scale transition is caused. Because the gray scale transition emphasis process can reduce the response time in the pixel, it is possible to accordingly reduce the average of response times in the pixels of the specific area.

"Selectively" appearing in "creating, selectively . . . an emphasis display signal by performing a gray scale transition process with respect to a display signal" and "in condition that the gray scale transition process has been selectively carried out with respect to the gray scale transition" does not mean that each gray scale transition requires to be processed by the gray scale transition emphasis process, but means that the gray scale transition emphasis process is carried out to only gray scale transitions in need thereof. This is because there is a gray scale transition to which a response time in a pixel is so short that it is not necessary to carry out the gray scale transition emphasis process.

By the gray scale emphasis process, it is possible to increase the brightness of each pixel in the midst of a gray scale transition. As such, it is possible to more effectively remove the adverse effect that the halfway change in the gray scale transition is reflected in the brightness of each pixel.

Further, by the gray scale transition emphasis process, it is possible to reduce the response time in each pixel. Therefore, it is possible to make the off period of each light source shorter and the on period of each light source longer, as compared to a case in which no gray scale transition emphasis process is carried out. As such, it is easy to obtain a bright display.

A display device of the present invention includes: a light source; a display driving section for causing pixels forming a display screen to display information, by driving the pixels in accordance with a display signal so as to modulate, via each pixel, intensity of light emitted from the light source; a light source driving section for blinking the light source in accordance with a frame frequency of the display signal; and a time data obtaining section for finding an average of a response time required for each pixel of a specific area of the display screen to respond to a gray scale transition caused between a frame and an adjacent frame following the frame, the light source driving section including: a light signal control section which determines, after the gray scale transition, at least one of the following (i) and (ii) in accordance with the average of response times in the specific area, (i) a length of an off period of the light source in a first half part of a one frame and (ii) a length of an on period of the light source in a second half part of the one frame; and an on/off control section which blinks the light source in accordance with the on period or the off period determined in length.

With the arrangement, the time data obtaining section finds the average of response times in each of the plurality of pixels to respond to a gray scale transition between a frame and an adjacent frame following the frame. For finding of the average of response times, an lookup table, which stores therein a measured response time of each pixel in association with a combination of a gray scale before the gray scale transition and a gray scale after the gray scale transition, may be stored in a memory. Alternatively, it may be arranged so that a software process is carried out in which the gray scale transition process circuit computes a response time in each pixel by use of a suitable one of prepared one or more formulas.

Thereafter, the lighting signal control section of the light source driving section determines at least one of the following (i) and (ii) in accordance with the average of response times thus found by the time data obtaining section, (i) the length of the off period of the light source in the first half part of the one frame and (ii) the length of the on period of the light source in the second half part of the one frame. For the determination, a lookup table may be stored in a memory, which lookup table stores therein time information for giving a timing of the on or off period of the light source in accordance with the average of response times. Alternatively, it may be arranged so that a software process, such as one which computes time information giving a timing of the on or off period of the light source in accordance with the average of response times, is carried out.

Subsequently, after the gray scale transition, the on/off control section of the light source driving section drives, at least in the adjacent frame in which the gray scale transitions is caused, each light source in accordance with the on period or the off period thus determined.

On this account, the on period or the off period of each light source is adjusted as appropriate in accordance with the various gray scale transitions caused in the respective pixels of each specific area. That is, as for a gray scale transition for which the average of the times is long, the off period in the first half part of the one frame is extended so as to remove as much as possible an adverse effect that halfway change in the gray scale transition is reflected in the brightness of each pixel.

The display method of the present invention thus can reduce the moving imaging blurring caused in the moving image display.

A display device of the present invention includes: a light source; a display driving section for causing pixels forming a display screen to display information, by driving the pixels in accordance with a display signal so as to modulate, via each pixel, intensity of light emitted from the light source; a light source driving section for blinking the light source in accordance with a frame frequency of the display signal; a gray scale process section for creating, selectively for a pixel out of pixels belonging to a specific area of the display screen in which pixel a gray scale transition is caused between a frame and an adjacent frame following the frame, an emphasis display signal by performing a gray scale transition process with respect to a display signal in the adjacent frame in which the gray scale transition is caused; and a time data obtaining section for finding an average of a response time required for each of the pixels belonging to the specific area of the display screen to respond, in a condition that the gray scale transition emphasis process has been selectively carried out in the pixel in which the gray scale transition is caused, the light source driving section including: a light signal control section which determines, after the gray scale transition, at least one of the following (i) and (ii) in accordance with the average of response times in the specific area, (i) a length of an off period of the light source in a first half part of a one frame and (ii) a length of an on period of the light source in a second half part of the one frame; and an on/off control section which blinks the light source in accordance with the on period or the off period determined in length.

The display device of the present invention is different from the display device of the present invention described earlier in terms that the time data obtaining section obtains the average of response times in the pixels of the specific area, in a condition that the gray scale transition process section has carried out the gray scale transition emphasis process to the display signal in the adjacent frame in which the gray scale transition is caused.

As described earlier, this can effectively remove the adverse effect that the halfway change in the gray scale transition is reflected in the brightness of each pixel. Also, by carrying out the gray scale transition emphasis process, it is possible to make the on period of the light source longer than in a case where no gray scale transition emphasis process is carried out. As such, it is easy to obtain a bright display.

For a fuller understanding of the nature and advantages of the invention, reference should be made to the ensuing detailed description taken in conjunction with the accompanying drawings.

Advantageous Effects of Invention

A display method and a display device of the present invention are arranged so that an off period of a light source is set to a suitable length in accordance with a gray scale transition time, and the light source is turned off for the suitable length of the off period within a first half part of a one frame period.

This can prevent as much as possible an adverse effect that a halfway change in a gray scale transition is reflected in a brightness of a pixel. As such, it is possible to reduce moving image blurring caused in a moving image display.

Moreover, the display method and the display device of the present invention are further arranged so that a gray scale transition emphasis process is carried out with respect to a display signal in a case where the gray scale transition is caused.

This can increase the brightness of the pixel in the midst of the gray scale transition and reduce a response time of the pixel. As such, it is possible to further improve a quality of the moving image display.

BRIEF DESCRIPTION OF DRAWINGS

FIG. 10(*b*) is a timing chart showing frame information of each signal in a case where a shift in frame phase is caused in the LED video signal.

FIG. 11(*b*) is a timing chart showing frame information (phase information) of each signal in a case where a shift in phase is caused in the LED video signal.

DESCRIPTION OF EMBODIMENTS

Outline of One Display Method of the Present Invention

First, a display method of the present invention is outlined. For easy explanation, the following describes one pixel of a plurality of pixels forming a display screen. One light source is provided for the pixel.

Figure 1:
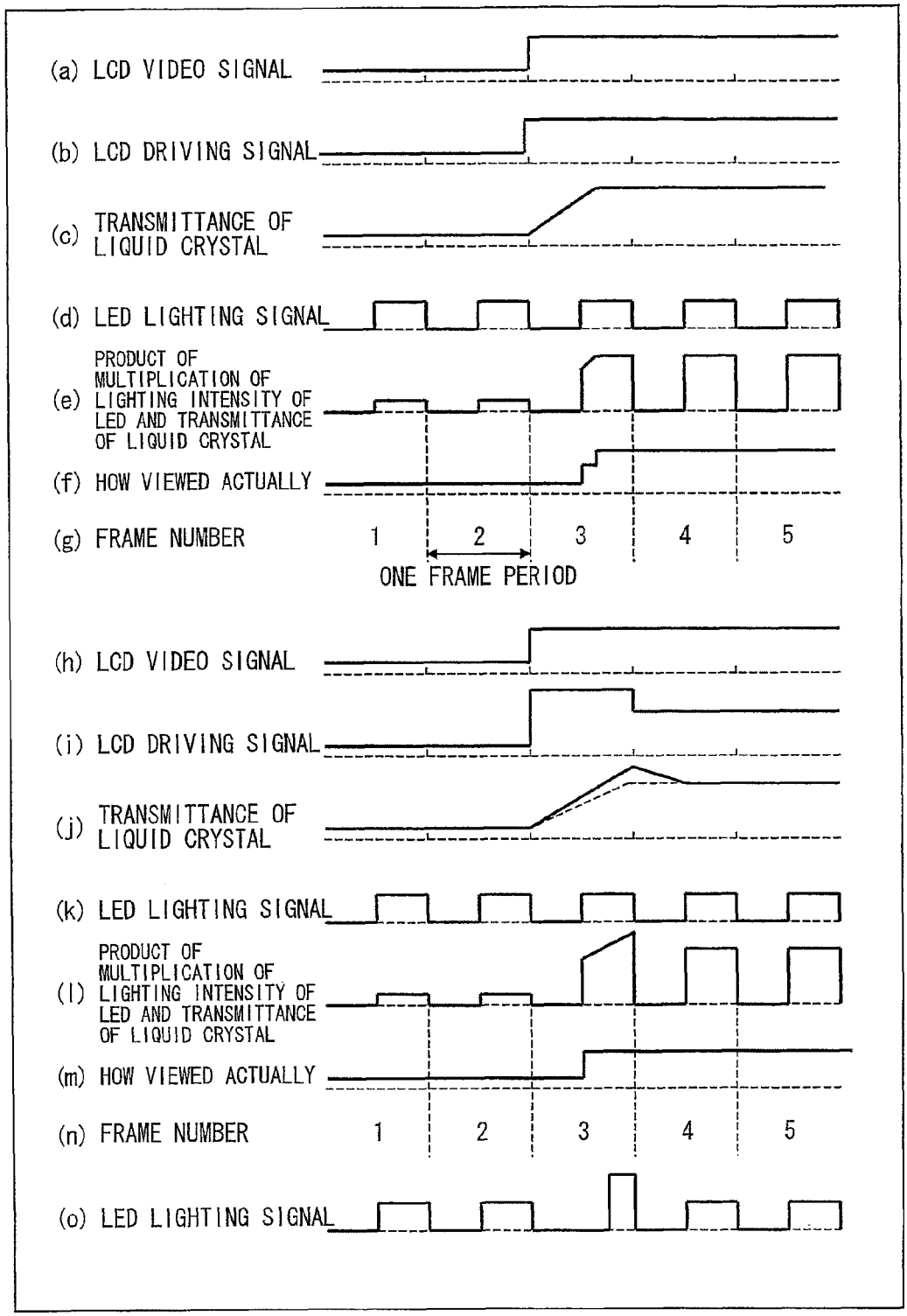
FIG. 1 (a) through (o) of FIG. 1 are timing charts. (a) through (g) of FIG. 1 show a display method in which no OS driving is carried out, (h) through (n) of FIG. 1 show a display method in which OS driving is carried out, and (o) of FIG. 1 shows an LED lighting signal applicable to both of the display methods.

(a) through (g) of FIG. 1 are timing charts showing how an image is actually viewed in a case where an LCD video signal (display signal), which drives a pixel of an LCD serving as a display device, has a gray scale transition, in a time line on which waveforms of the following (i) through (iii) are adjusted, (i) an input and output of each signal, (ii) a transmittance of liquid crystal (response in pixel), and (iii) a value obtained by integrating, by a lighting time of a light source, a product of multiplication of the transmittance of liquid crystal and a lighting intensity of the backlight.

Assume that an LCD video signal corresponding to a given pixel is changed from a low gray scale to a high gray scale in a frame which is, for convenience, labeled with a frame number 3 (see (a) and (g) of FIG. 1). In this case, an LCD driving signal created based on the LCD video signal (see (b) of FIG. 1) is applied to the pixel. This causes a liquid crystal in the pixel to have a change in transmittance at a response speed corresponding to a gray scale change (see (c) of FIG. 1).

In this case, the response speed is relatively great, i.e., a response time is relatively short. Thus, no tone transition emphasis process is carried out with respect to the LCD video signal.

An LED lighting signal shown in (d) of FIG. 1, which switches a light emission diode (LED) forming a backlight of an LCD between "on" and "off", is created in response to a gray scale transition in a frame 3 so that an "off" period, a length of which corresponds to the response time, is set within a first half part of a one frame period at least in the frame 3, i.e., an "on" period of the backlight, a length of which corresponds to the response time, is set within a second half part of the one frame period at least in the frame 3.

In a case where the LED lighting signal is supplied, a brightness of the given pixel is rarely affected by a change in transmittance of a liquid crystal in the given pixel within the first half part of the frame 3 (see (e) and (f) of FIG. 1). This is because the brightness of the given pixel is equal to an integration value found by integrating a product of multiplication of the transmittance of the liquid crystal and a lighting intensity of the LED by a lighting time of the backlight. Because the brightness of the pixel is thus rarely affected, a contour of an image is greatly clearer than in a conventional display method described with reference to FIG. 13. As such, a display quality is improved as compared to that in the conventional display method.

According to the arrangement, a non-lighting rate, which is found by dividing the "off" period by the one frame period, is varied depending on a length of the response time is. Specifically, the longer the response time is, the more likely a midway condition of a gray scale transition is displayed in the pixel and the contour of the image is blurred. Thus, the LED is preferably kept to the "off" condition until the gray scale transition is completed. That is, the longer the response time is, the greater the non-lighting rate is.

The "on" period of the LED lighting signal (see (d) of FIG. 1) corresponding to the frame 3 may be further shortened so that the LED is completely off during the midway condition of the gray scale transition, as shown in (o) of FIG. 1. However, the greater the non-lighting rate is, the more likely the brightness of the pixel is insufficient. An example of a countermeasure to this problem may be to increase an intensity of the LED lighting signal corresponding to the frame 3, as shown in (o) of FIG. 1.

Outline of Further Display Method of the Present Invention

A further display method of the present invention is outlined below. According to the further display method, an LCD driving signal shown in (i) of FIG. 1 is created by carrying out a tone transition emphasis process with respect to an LCD video signal (see (h) of FIG. 1) in response to a gray scale transition in a frame 3.

In a case where the given pixel is driven by the LCD driving signal thus created, a response speed in the given pixel is speeded up. This causes an instantaneous rise in the transmittance of the liquid crystal and thereby causes a decrease in the response time (see (j) of FIG. 1).

The transmittance of the liquid crystal in the given pixel is thus increased so that a product of multiplication of the transmittance of the liquid crystal in the given pixel and the lighting intensity of the LED is increased greater than that shown in (e) of FIG. 1 (see (i) of FIG. 1). This prevents the midway condition of the gray scale transition from appearing in a display by the given pixel, as shown in (m) of FIG. 1. As such, it is possible to obtain a display quality improved further than that shown in (f) of FIG. 1.

Arrangement and operation of a display device that realizes the display method are described in more detail below.

First Embodiment

Arrangement of Display Device

With reference to FIGS. 2 through 9, the following describes one example of a liquid crystal display device (hereinafter abbreviated to LCD) to which the display device of the present invention is applied.

Figure 2:
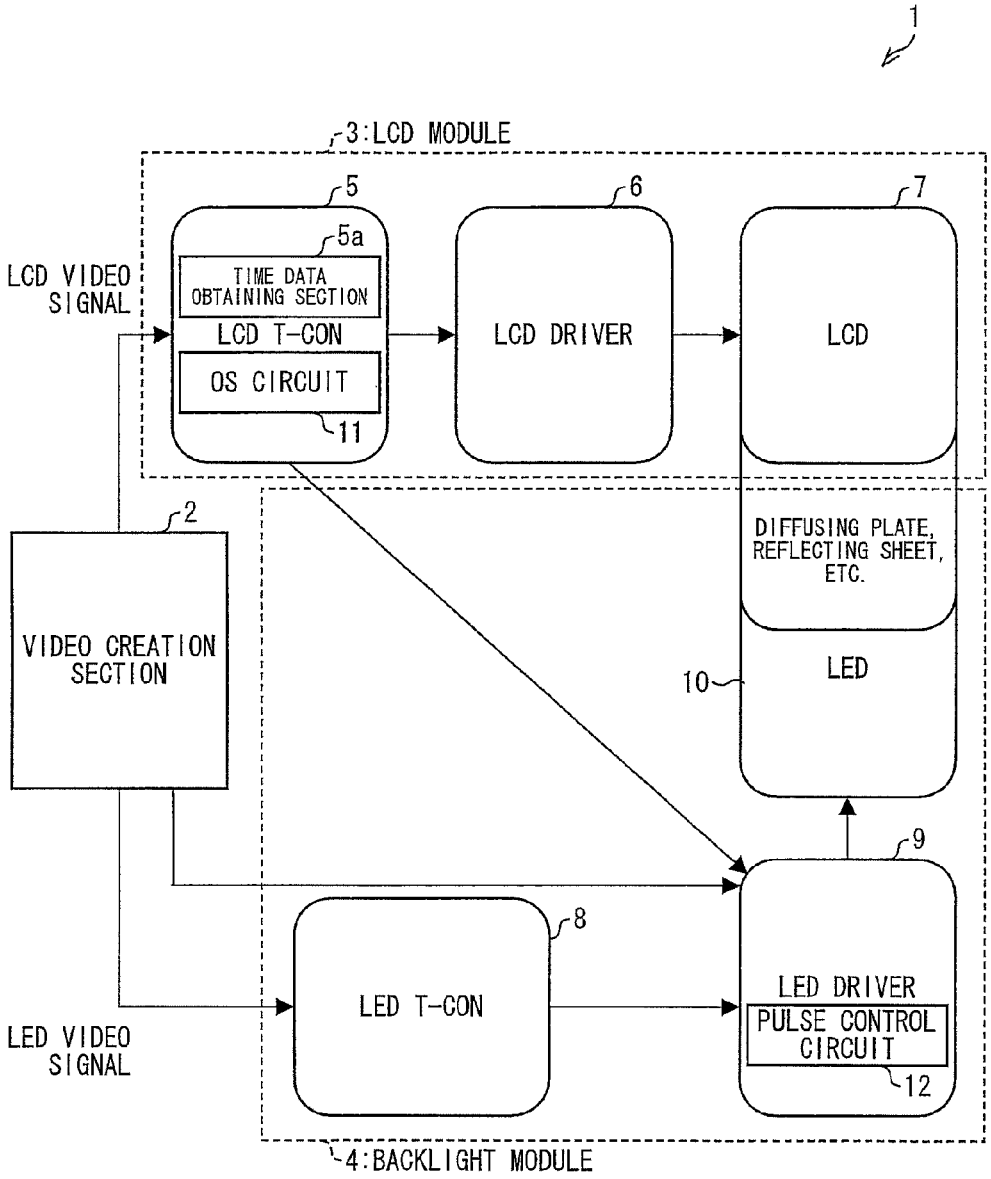
FIG. 2 is a block view schematically showing an internal arrangement of a liquid crystal display device in accordance with one embodiment of the present invention.

FIG. 2 is a view schematically showing an internal arrangement of an LCD 1. In the LCD 1, a light emitting diode (hereinafter abbreviated to LED) 10 is used as a light source. Instead of the LED 10, another light emitting element such as an organic electroluminescence (EL) element, an inorganic EL element, or the like, may be used as the light source of the LCD 1.

As shown in FIG. 2, the LCD 1 includes, a video creation section 2, an LCD module 3, and a backlight module 4. The LCD module 3 includes an LCD timing control circuit (hereinafter referred to as LCD_T-CON) 5, an LCD driver 6, and an LCD panel 7. The backlight module 4 includes an LED timing control circuit (hereinafter referred to as LED_T-CON) 8, an LED driver 9, and a plurality of LEDs 10.

The plurality of LEDs 10 are provided at intervals in a two-dimensional manner on a backside surface of the LCD panel 7 opposite to a front side surface, so as to form a backlight. A surface of a substrate on which surface the plurality of LEDs 10 are provided has a reflecting sheet by which light emitted thereto from the plurality of LEDs 10 is directed toward the LCD panel 7. Further, in order for the LCD panel 7 to have a uniform brightness distribution, an optical sheet such as a diffusing plate, etc. is provided between the LCD panel 7 and the plurality of LEDs 10.

A front surface of the LCD panel 7 has a plurality of areas (specific areas of a display screen) for which the respective plurality of LEDs 10 are provided. In the LCD panel 7, a so-called area active backlight system is employed in which each of the plurality of areas is driven, independently from each other, in accordance with a corresponding gray scale display.

It is suitable that the number of the plurality of areas is large whereas the number of pixels of the LCD panel 7, to which pixels one LED 10 corresponds, is small, from a perspective of improving a display quality in the LCD 1. However, it is preferable that both the number of the plurality of areas and the number of pixels of the LCD 7, to which one LED 10 corresponds, are optimized in view of a cost, a weight of a device, a power consumption, etc.

The following outlines operations of the respective constituents of the LCD 1. First, the video creation section 2 determines the following (i) and (ii) in accordance with image data (video input signal) that will be displayed on the LCD 1; (i) a gray scale in each pixel of the LCD panel 7 and (ii) a brightness of an LED 10 of each area. Then, the video creation section 2 supplies data of the gray scale in each pixel thus determined to the LCD module 3 as an LCD video signal (display signal) and data of the brightness of the LED 10 of each area thus determined to the backlight module 4 as an LED video signal. In response, the LCD module 3 controls a gray scale in the LCD panel 7 in accordance with the LCD video signal received from the video creation section 2.

More specifically, in the LCD module 3, the LCD video signal received from the video creation section 2 is supplied to the LCD_T-CON 5. In response, the LCD_T-CON 5 adjusts a timing of the LCD video signal. Then, the LCD video signal with an adjusted timing is supplied to the LCD driver 6 as an LCD driving signal. In response, the LCD driver 6 controls the gray scale in the LCD panel 7 in accordance with the LCD driving signal.

The LCD driver 6 corresponds to "a display driving section for causing a pixel forming a display screen to display information, by driving the pixel in accordance with a display signal and modulating, by the pixel, an intensity of light emitted from a light source".

The LCD_T-CON 5 includes a time data obtaining section 5*a*. The time data obtaining section 5*a* finds an average of response times required for pixels of each area to respond to a gray scale transition between adjacent frames.

In the backlight module 4, on the other hand, the LED video signal received from the video creation section 2 is supplied to the LED_T-CON 8. In response, the LED_T-CON 8 adjusts a timing of the LED video signal. Also, the LED_T-CON 8 finds an average gray scale in each area and determines a brightness of the LED 10 of each area, and thereby creates an LED data for each area. Then, the LED video data is supplied to the LED driver 9. In response, the LED driver 9 creates an LED lighting signal which causes the LED 10 of each area to emit light of an adjusted brightness in accordance with an adjusted on/off timing.

The LED driver 9 corresponds to "a light source driving section for blinking the light source in accordance with a frame frequency of a display signal".

With the arrangement, the light emitted from the LED 10 of each area, the brightness of which light is determined based on the gray scale in each area, is modulated by the pixels of each area in accordance with the gray scales in the respective pixels of each area. This enables displaying a video of a high quality.

In the LCD 1 of the present embodiment, the LCD_T-CON 5 further includes an overshoot (OS) circuit 11 (a gray scale processing section) and causes the OS circuit 11 to control OS driving later described. This can improve response speeds of liquid crystals during a moving image display on the LCD 1.

Further, in the LCD 1 of the present embodiment, the LED driver 9 includes a pulse control circuit 12 (lighting signal control section), and is capable of causing the pulse control circuit 12 to control (i) blinking of the LED which turns on and off to blink in synchronization with a frame cycle of the LCD video signal or that of the LED video signal and (ii) a lighting period and a blanking period of the LED 10 within one frame cycle. That is, it is possible to set the blanking period of the LED 10 within a first half part of the one frame cycle and the lighting period of the LED 10 within a second half part of the one frame cycle following the first half part.

Thus, the LCD 1 of the present embodiment can increase response speeds of liquid crystals within a gray scale transition and reduce moving image blurring in a moving image display. These effects brought about by the LCD 1 of the present embodiment 1 are later described in detail.

Arrangement of OS Circuit 11

As described earlier, the LCD 1 of the present embodiment makes use of the OS driving by the OS circuit 11. According to the OS driving, response speeds of liquid crystal molecules are improved. This is because, in a case where a gray scale transition falls within a range where the response speeds of the liquid crystal molecules are slow, an electric potential greater than an ordinary one is applied to the liquid crystal molecules when a gray scale is switched from a given gray scale to another gray scale.

Specifically, in order for a target pixel to be switched from a gray scale A to a gray scale B grater than the gray scale A, a writing voltage corresponding to a gray scale B' (correction gray scale) greater than the gray scale B is applied to the target pixel for a predetermined period. After this, a writing voltage corresponding to the gray scale B, i.e., a target gray scale, is applied to the target pixel. This accelerates a change in alignment of the liquid crystal molecules, and thereby improves the response speeds of the liquid crystal molecules. As such, it is possible to further improve a speed of switching of the target pixel from the gray scale A to the gray scale B.

In contrast to the above case, in order for the target pixel to be switched from the gray scale A to a gray scale C less than the gray scale A, a writing voltage corresponding to a gray scale C' (correction gray scale) less than the gray scale C is applied to the target pixel for a predetermined period. This can bring about an effect similar to the one brought about in the above case.

In such OS driving, generally, the OS circuit 11 outputs, with reference to a lookup table (LUT), a predetermined correction gray scale in accordance with a gray scale before the gray scale transition and a gray scale after the gray scale transition.

Figure 3:
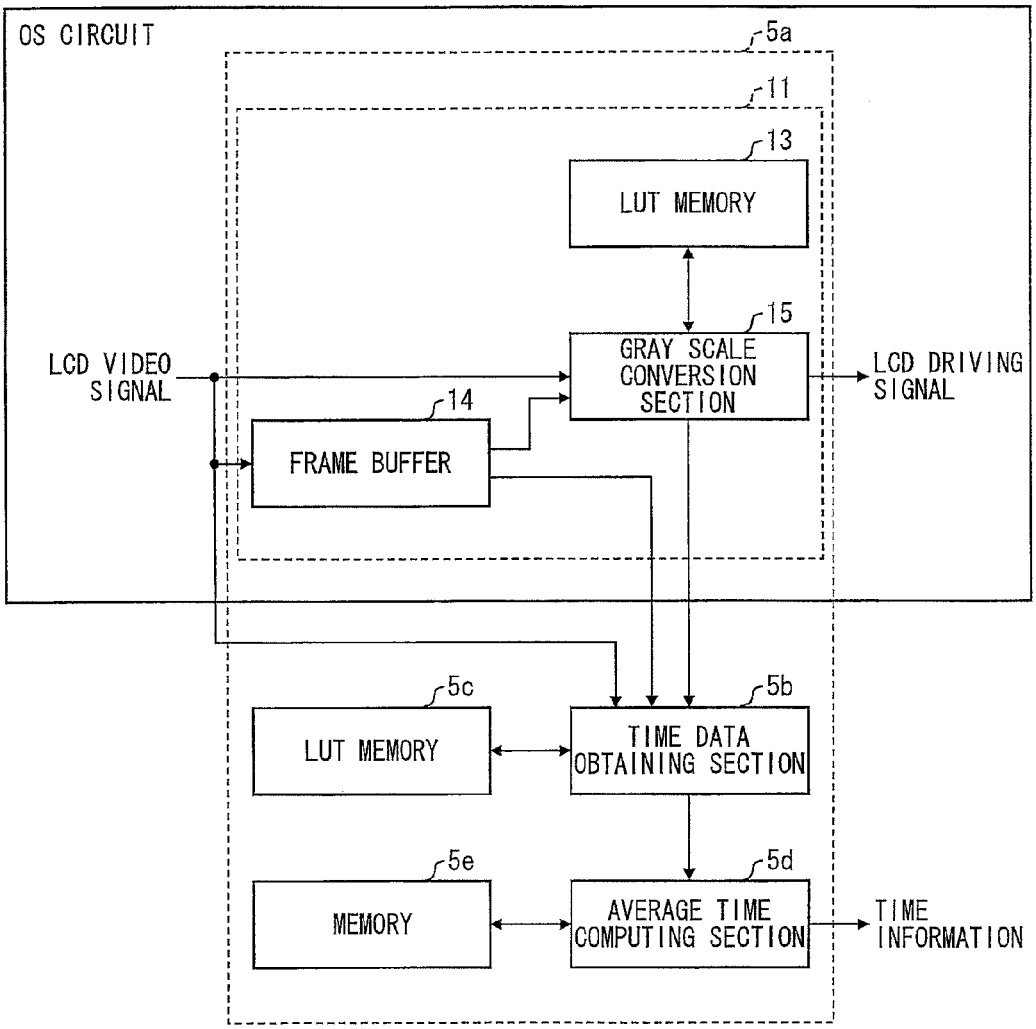
FIG. 3 is a block view showing internal arrangements of an overshoot circuit and a time data obtaining section included in the liquid crystal display device.
Figure 4:
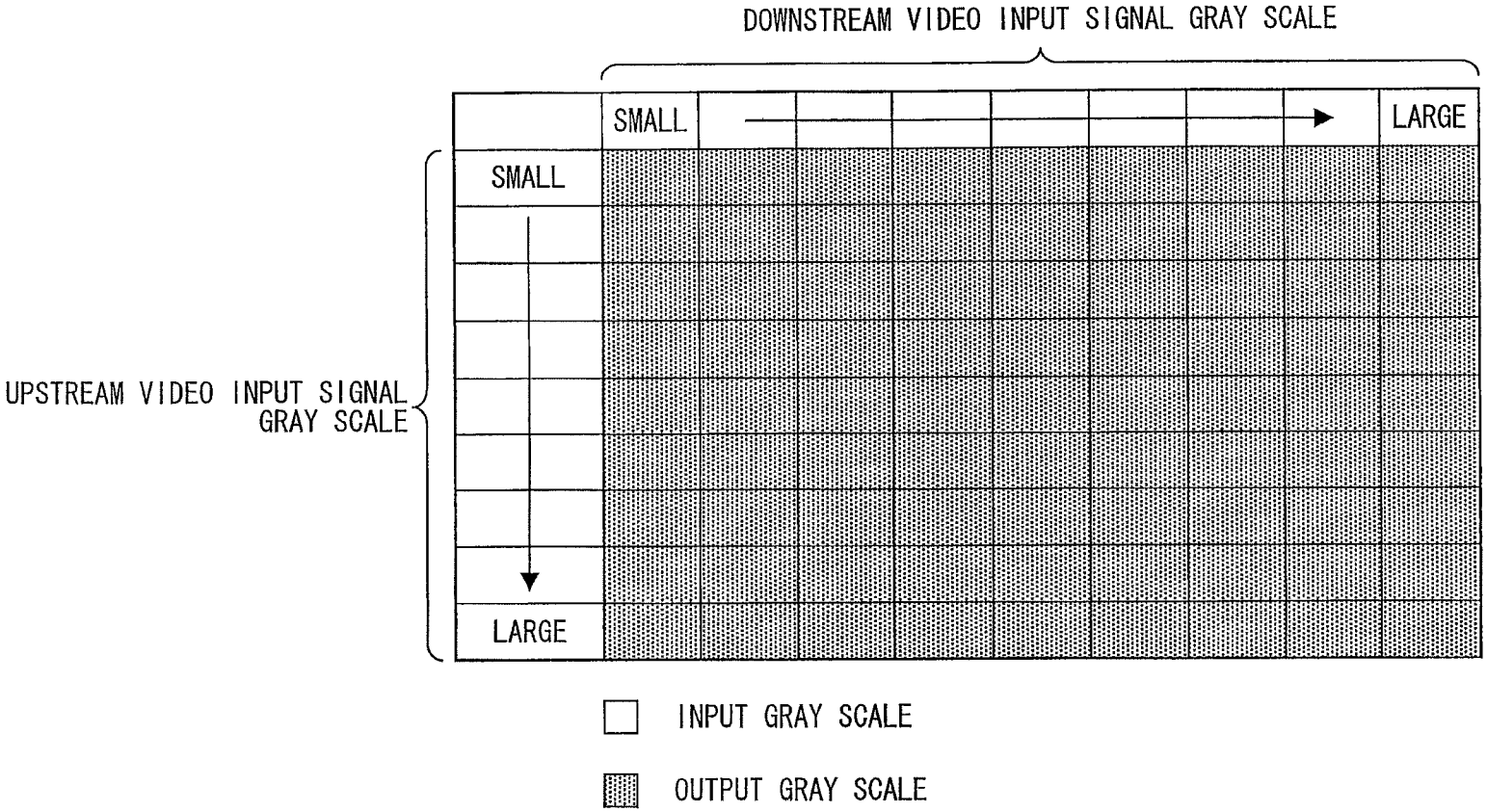
FIG. 4 is a conceptual view schematically showing a LUT in which a corrected gray scale, which is to be outputted, is associated with a combination of a gray scale in a previous frame (i.e., upstream video input signal gray scale) and a gray scale in a current frame following the previous frame (i.e., downstream video input signal gray scale).

With reference to FIGS. 3 and 4, the following describes the OS driving circuit 11 of the LCD_T-CON 5. FIG. 3 is a block view showing an arrangement of the OS circuit 11 and an arrangement of the time data obtaining section 5*a*. FIG. 4 is a conceptual view schematically showing an LUT in which correction gray scales to be outputted are associated with respective combinations of a gray scale in a pervious frame (upstream video input signal gray scale) and a gray scale in a current frame (downstream video input signal gray scale) following the previous frame.

As shown in FIG. 3, the OS circuit 11 includes an LUT memory 13, a frame buffer (frame memory) 14, and a gray scale conversion section 15. The LCD video signal received from the video creation section 2 is supplied to the frame buffer 14 and the gray scale conversion section 15. The frame buffer 14 is a frame memory which temporarily stores therein an LCD video signal in the previous frame.

Specifically, the frame buffer 14 holds, for a one frame period (one vertical period), the LCD video signal received from the video creation section 2. That is, the frame buffer 14 keeps holding the LCD video signal in the current frame until an LCD video signal in a next frame is supplied. It follows that the frame buffer 14 always holds an LCD video signal in a previous frame followed by a current frame.

The LUT memory 13 stores therein the LUT for the OS driving. The LUT memory 13 may store a plurality of LUTs corresponding to a respective plurality of temperature conditions, so that OS driving suitable in a current temperature condition can be carried out irrespectively of a change in a temperature condition.

An LCD video signal in the current frame, which is received from the video creation section 2, is outputted to the frame buffer 14 and the gray scale conversion section 15. In response to this, the LCD video signal in the previous frame is supplied from the frame buffer 14 to the gray scale conversion section 15. On reception of the LCD video signals in the previous and current frames, the gray scale conversion section 15 obtains, from the LUT memory 13, a correction gray scale associated with gray scales in the respective LCD video signals in the previous and current frames. After this, the correction gray scale thus obtained is supplied to the LCD driver 6 as an LCD driving signal. This can speed up response speeds of liquid crystal molecules in a case where the gray scale transition falls within the range where the response speeds of the liquid crystal molecules are slow.

In a case where a gray scale transition falls within a range where response speeds of the liquid crystal molecules are so fast that no OS driving is required, an LCD video signal in a current frame is directly stored in the LUT memory 13 as a correction gray scale. This enables outputting the raw gray scale without necessity of carrying out the OS driving.

Arrangement of Time Data Obtaining Section 5*a*

The following describes an arrangement of the time data obtaining section 5*a* that finds an average of response times required for the pixels of each area to respond to a gray scale transition caused between adjacent frames. As shown in FIG. 3, the time data obtaining section 5*a* includes the OS circuit 11, a time data creation section 5*b*, a LUT memory 5*c*, an average time computing section 5*d*, and a memory 5*e*.

The LUT memory 5*c* stores therein a predetermined gray scale transition time (a response time) in association with a gray scale of an LCD video signal in a previous and a correction gray scale.

The time data creation section 5*b* receives (i) the LCD video signal in the previous frame from the frame buffer 14 and (ii) the LCD driving signal, in which the correction gray scale is reflected, from the gray scale conversion section 15.

After this, the time data obtaining section 5*b* obtains, from the LUT memory 5*c*, a gray scale transition time corresponding to the gray scale of the LCD video signal in the previous frame and the corrected gray scale. Then, the gray scale transition time thus obtained is supplied to the average time computing section 5*d*. The gray scale transition time encompasses gray scale transition times in the respective pixels.

On reception of the gray scale transition time in each pixel from the time data creation section 5*b*, the average time computing section 5*d* stores it in the memory 5*e* in association with each area. After this, the average time computing section 5*d* reads out gray scale transition times in respective pixels of each area, computes their average, and outputs it as time information.

The gray scale transition time may be found for each of gray scales between a minimum gray scale and a maximum gray scale. Alternatively, the gray scale transition time may be found for every given number of gray scales so that a data amount of each LUT can be reduced. In this case, as for a gray scale transition for which no gray scale transition time is found, it is suitable to find a gray scale transition time by interpolation computation in accordance with gray scale transition times for closest two gray scale transitions.

The above description of the time data obtaining section 5*a* is made based on assumption that the OS driving is carried out. However, in a case where no OS driving is carried out, the time data creation section 5*b* may receive the LCD video signal in the current frame from the video creation section 2, instead of receiving the LED driving signal from the gray scale conversion section 15, as shown in FIG. 3. Even in this case, it is possible to obtain, with the use of the LUT memory 5*c*, a gray scale transition time corresponding to gray scales in respective previous and current frames.

Arrangement of LED Driver

Figure 5:
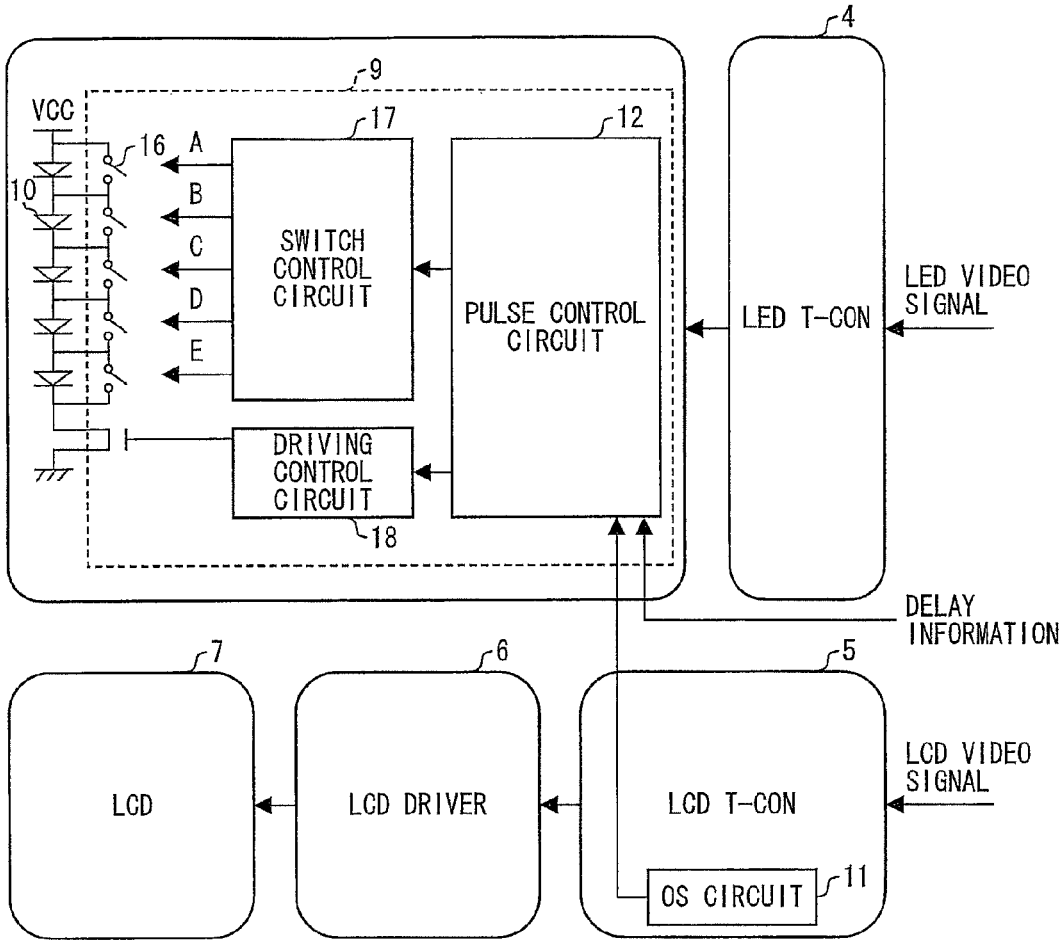
FIG. 5 is a block view showing an internal arrangement of an LED driver in the liquid crystal display device shown in FIG. 2.

FIG. 5 more concretely shows an arrangement of the LED driver 9. As shown in FIG. 5, the LED driver 9 includes (i) switches 16 each of which is connected in parallel with a corresponding one of a plurality of LEDs 10 connected in series with each other, (ii) a switch control circuit 17 (on/off control section) for switching each of the switches 16 between on and off independently from each other, (iii) a driving control circuit 18 for constant-current driving the plurality of LEDs 10 in accordance with the timing adjusted by LED_T-CON 4, and (iv) a pulse control circuit 12 for controlling the switch control circuit 17 and the driving control circuit 18.

Arrangement of Pulse Control Circuit 12

Figure 6:
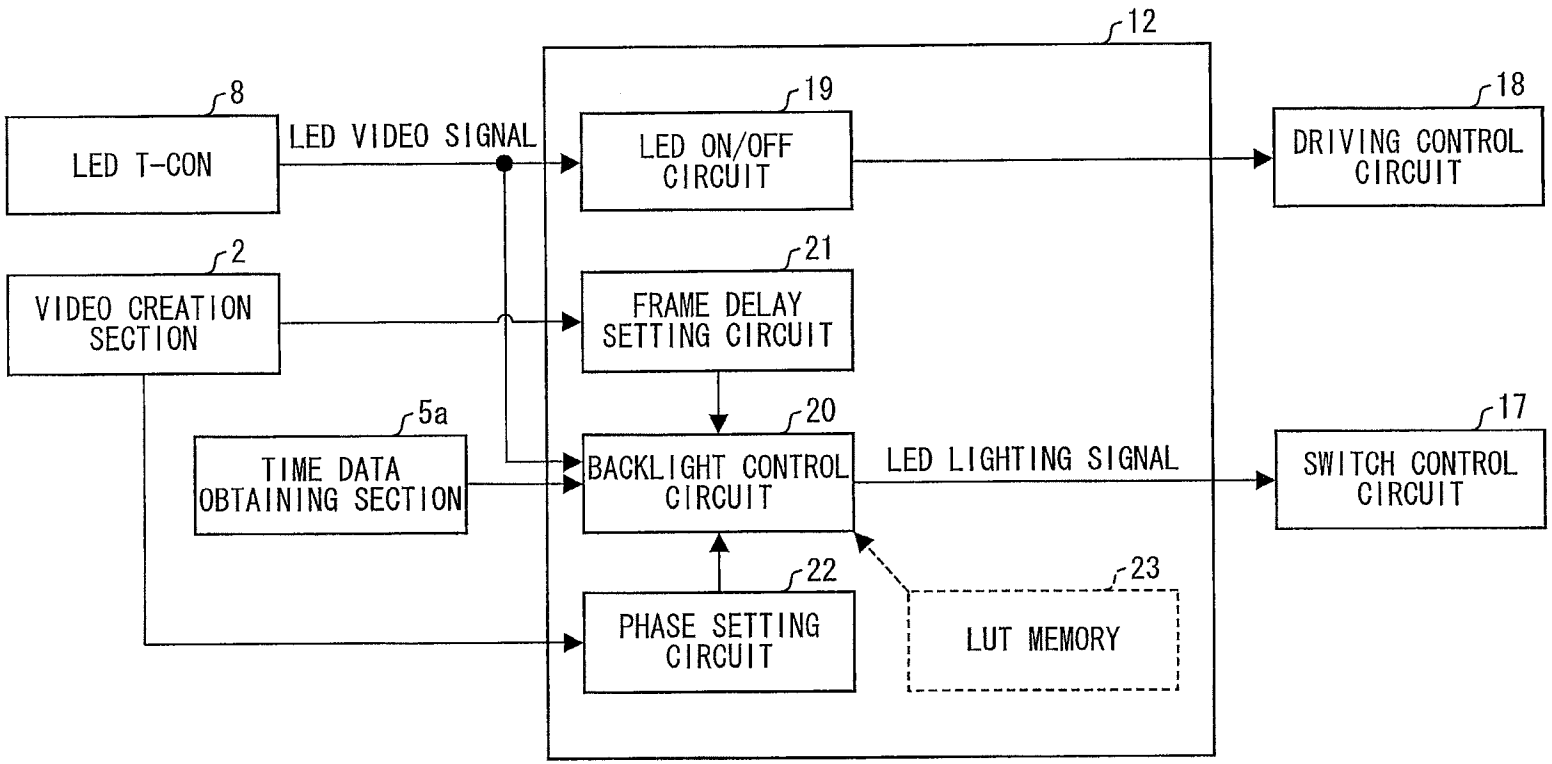
FIG. 6 is a block view showing an arrangement of a pulse control circuit included in the LED driver.

FIG. 6 is a block view showing an arrangement of the pulse control circuit 12. As shown in FIG. 6, the pulse control circuit 12 includes an LED ON/OFF circuit 19, a backlight control circuit 20 (lighting signal control section), a frame delay setting circuit 21 (frame delay setting section), and a phase setting circuit 22 (phase setting section). The backlight control circuit 20 includes an LUT memory 23 in which a gray scale transition time is stored in association with an on period or an off period of each LED 10.

The LED ON/OFF circuit 19 receives the LED video data created by the LED_T-CON 8 and, in response, controls a timing of the constant-current driving to be carried out by the driving control circuit 18.

Figure 9:
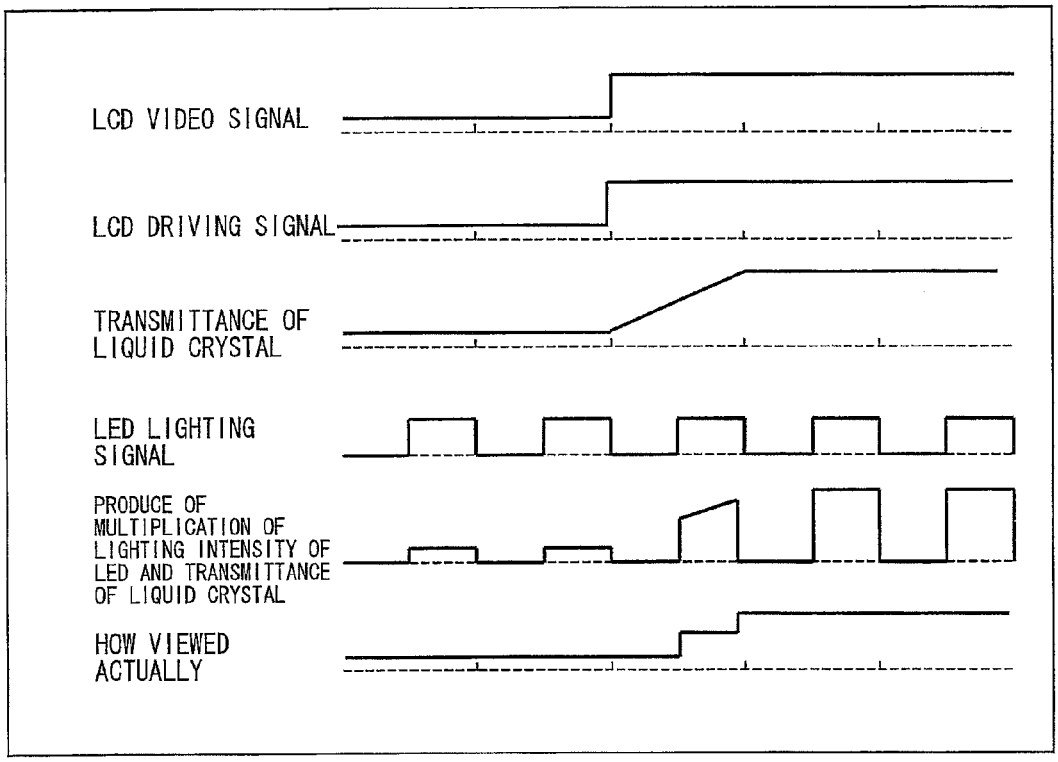
FIG. 9 is a timing chart (i) obtained in an comparative example in which backlight control is carried out without carrying out overshoot driving and (ii) showing how an image is actually viewed on the liquid crystal display device, in condition that waveforms of the following (a) through (c) are aligned, (a) an input and an output of each signal, (b) a transmittance of liquid crystal, and (c) a value obtained by integrating, by a lighting time, a product of multiplication of the transmittance of liquid crystal and a lighting intensity of a backlight.

The backlight control circuit 20 receives the LED video data from the LED_T-CON 8. In response, the backlight control circuit 20 creates an LED lighting signal as shown in FIG. 9, which is a pulse string signal repeatedly switched between on and off pulses in synchronization with the frame cycle of the LCD video signal or the frame cycle of the LED video signal. In order to create the LED lighting signal, the backlight control circuit 20 (i) obtains the time information (i.e., the average of the response times required for the pixels of each area to respond to the gray scale transition caused between the adjacent frames) from the time data obtaining section 5*a*, and (ii) obtains, from the LUT memory 23, the on period or the off period corresponding to the average of the response times thus obtained.

In a case where the LUT memory 23 stores therein the number of counts of a master clock which correspond to the off period in the first half part of the one frame, the backlight control circuit 20 can create the LED lighting signal by use of (i) an output of a counter that counts the master clock, (ii) a clock being synchronized with a start of each frame, and (iii) the master clock.

This enables determining, for each LED 10 of each area, at least one of a length of the on period in the first half part of the one frame and a length of the off period in the second half part of the one frame.

The switch control circuit 17 switches each of the switches 16 between on and off independently from each other, in accordance with the LED lighting signal. This causes blinking of the LEDs 10.

The frame delay setting circuit 21 and the phase setting circuit 22 receive information of a time (delay time) of a delay caused in the LCD video signal due to the signal process in the video creation section 2. In response, the frame delay setting circuit 21 and the phase setting circuit 22 causes a delay in the LED lighting signal created by the backlight control circuit 20, in accordance with the delay time thus received. This is later described in detail as a further embodiment.

Backlight Control Operation 1

The following describes a backlight control operation employed in a case where no OS driving is carried out.

The video creation section 2 creates, for a given pixel, an LCD video signal shown in (a) of FIG. 1. The LCD video signal has a gray scale transition in a frame 3 (see (g) of FIG. 1). The LCD_T-CON 5 adjusts a timing of the LCD video signal and creates an LCD driving signal (see (b) of FIG. 1) to which no OS driving is carried out.

The greater a gray scale of the LCD video signal is, the greater a voltage value of the LCD video signal is. The given pixel belongs to a corresponding one (hereinafter referred to as a focused area) of the plurality of areas of the display screen of the LCD panel 7. In some of the rest of pixels belonging to the focused area, same gray scale transitions as above are caused, whereas in the others of the rest of pixels belonging to the focused area, different gray scale transitions different from the above, including no gray scale transition, are caused.

The time data obtaining section 5*a* obtains a gray scale transition time in each pixel of the focused area, and computes an average of gray scale transition times in the focused area. In the computation, 0 is substituted for a gray scale time in a pixel in which no gray scale transition is caused. (c) of FIG. 1 shows a transmittance of a liquid crystal in accordance with the average of the response times in the focused area.

Subsequently, the backlight control circuit 20 (i) obtains the average of the response times from the time data obtaining section 5*a*, (ii) determines an on or off period corresponding to it, with the use of LUT memory 23, and (iii) creates an LED lighting signal.

The LED lighting signal is such that, at least in the frame (the frame 3) in which the gray scale transition is caused, an off period for turning off the LED 10 is provided in most of a transient period during which the transmittance of the liquid crystal is being changed (see (d) of FIG. 1). A length of the off period is adjusted, like the length of the average of the response times in the focused area.

Figure 13:
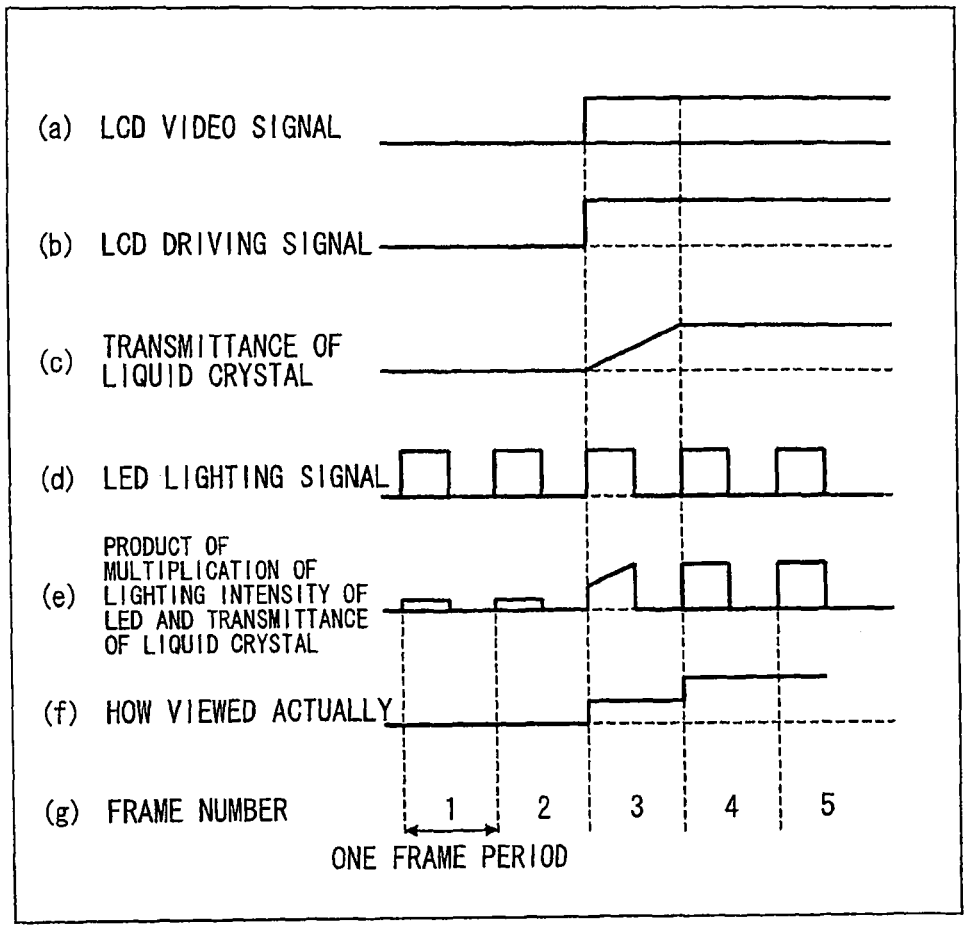
FIG. 13 is a timing chart obtained in a conventional display method, which shows how an image is actually viewed on a LCD, in condition that waveforms of the following (i) through (iii) are adjusted in timing, (i) an input and an output of each signal, (ii) a transmittance of liquid crystal, and (iii) a value obtained by integrating, by a lighting time, a product of multiplication of the transmittance of liquid crystal and a lighting intensity of a backlight.

This makes it possible to realize a moving image display which is greatly clearer in image contour than a moving image display by a conventional backlight control described with reference to FIG. 13.

However, if the off period is extended so that a non-lighting rate is increased, there is a risk that a brightness of the display is insufficient. In order to deal with this, it is suitable to increase an intensity of lighting instead of extending the off period (see (o) of FIG. 1). A configuration thus capable of varying intensities of lighting from area to area of a display screen is disclosed in the aforementioned patent literature 3, for example.

In the backlight control operation 1, the off period of the LED 10 is determined by use of the gray scale transition times obtained in a case where no OS driving is performed. Alternatively, the off period of the LED 10 may be determined in this way, even in a case where the OS driving is carried out with respect to the LED video signal in the OS circuit 11.

In a case of combining the backlight control operation 1 with the OS driving, it is possible to more increase a brightness of each pixel in the midst of a gray scale transition. As such, it is possible to more effectively remove an adverse effect that a halfway change in the gray scale transition is reflected in the brightness of each pixel.

Because it is possible to decrease the time required for each pixel to respond to the gray scale transition, it is possible to increase a probability that the gray scale transition is completed within the off period of the light source in the first half part of the one frame. As such, it is possible to remove with greater certainty the adverse effect that the halfway change in the gray scale transition is reflected in the brightness of the pixel.

Backlight Control Operation 2

The following describes a backlight control operation employed in a case where OS driving is carried out.

Figure 7:
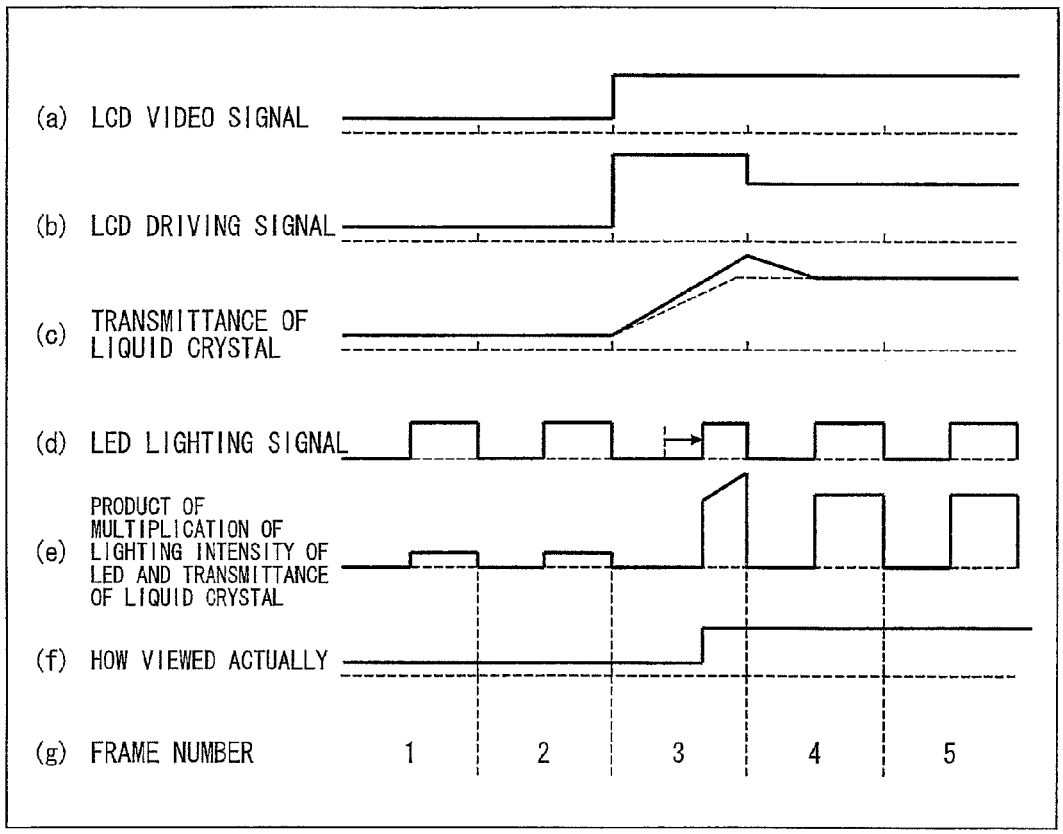
FIG. 7 are timing charts together showing how an image is actually viewed on the liquid crystal display device, in condition that waveforms of the following (i) through (iii) are adjusted, (i) an input and an output of each signal, (ii) a transmittance of liquid crystal, and (iii) a value obtained by integrating, by a lighting time, a product of multiplication of the transmittance of liquid crystal and a lighting intensity of a backlight.

The video creation section 2 creates an LCD video signal shown in (a) of FIG. 7, which LCD video signal has a gray scale transition in a frame 3 (see (g) of FIG. 7) and is supplied to a given pixel. The LCD video signal thus created is supplied to the OS circuit 11. In response, the OS circuit 11 determines a correction gray scale, as early described, so that an LCD driving signal shown in (b) of FIG. 7, whose gray scale in a frame 3 is emphasized, is created.

The given pixel belongs to a focused area. In some of the reset of pixels of the focused area, gray scale transitions same as one caused in the given pixel are caused, whereas in the others of the rest of pixels belonging to the focused area, gray scale transitions different from the one caused in the given pixel, including no gray scale transition, are caused.

The time data obtaining section 5*a* (i) obtains a gray scale transition time required, in a case where the OS driving has been carried out, in each of pixels belonging to a focused area and (ii) computes an average of the gray scale transition times thus obtained. As for a pixel in which no gray scale transition is caused, obviously, no OS driving is carried out. Thus, the computation is carried out by substituting 0 for the gray scale transition time in this pixel. A transmittance of liquid crystal shown in (c) of FIG. 7 corresponds to an average gray scale transition time thus computed.

Subsequently, the backlight control circuit 20 (i) obtains the average of the response times from the time data obtaining section 5*a*, (ii) determines an on or off period corresponding to it, with the use of LUT memory 23, and (iii) creates an LED lighting signal.

The LED lighting signal is such that, at least in the frame (the frame 3) in which the gray scale transition is caused, an off period for turning off the LED 10 is provided in most of a transient period during which a transmittance of a liquid crystal is being changed (see (d) of FIG. 7). A length of the off period is adjusted, like the length of the average of the response times in the focused area.

As compared to the case in which no OS driving is carried out, the transmittance of the liquid crystal increases rapidly, and then peaked out so as to have an angle-shaped waveform (see (c) of FIG. 7). As a result, as shown in (e) of FIG. 7, a value, i.e., brightness, obtained by integrating a product of an intensity of LED lighting and the transmittance of the liquid crystal by a lighting time is increased greater than in the case where no OS driving is carried out. On this account, the gray scale transition appears, to a viewer, to rapidly rise (see (f) of FIG. 7). That is, the viewer can view moving image display clear in image contour.

In a case where no OS driving is carried out, the transient condition of the response of the liquid crystal is slightly seen in the brightness (see (e) and (f) of FIG. 1). Thus, there is a probability that the gray scale transition may not fully rapidly rise.

For example, as shown in a comparative example in FIG. 9, in a case where a gray scale transition time is longer than a one frame period, an intermediate gray scale which is not originally intended is viewed in the gray scale transition. This is because, even if the backlight is extinguished in a first half part of the one frame period and then lighted in a second half part of the one frame period, the backlight is lighted while the gray scale transition is being caused. Consequently, it is impossible to reduce blurring in moving image.

In contrast, by performing the OS driving, it is possible to reduce the gray scale transition time less than the one frame period. Thus, by combining the OS driving with the backlight control of the present invention, it is possible to reduce the blurring in moving image with certainty.

Lighting Time of Backlight

The above description describes how to set the off period of the LED lighting signal in the frame in which the gray scale transition is caused, but does not describe how to set the off period in the frame in which no gray scale is caused.

Thus, the following describes how the off period is set in a frame in which no gray scale transition is caused.

To say the conclusion first, as for the frame in which no gray scale transition is caused, it is preferable that the off period is set to a fixed length and the LED driver 9 blinks the LEDs 10 in accordance with the fixed length of the off period. The LEDs 10 are blinked in synchronization with each frame.

A gray scale displayed in the frame, in which no gray scale transition is caused, is same as in at least a frame directly followed by this frame. Thus, the pixel is kept to a condition that the response (gray scale transition) has been completed. On this account, like a still image display, no problem of the blurring in moving image is caused in the frame in which no gray scale transition.

Therefore, in a case of setting the off period in the frame in which no gray scale transition is caused, it is not necessary to consider the blurring in moving image. Factors which are necessary to be considered encompass obtainment of a required brightness and a reduction in a power consumption. It is suitable that the off period (or the on period) is set to a most suitable fixed length in consideration of these factors.

Figure 8:
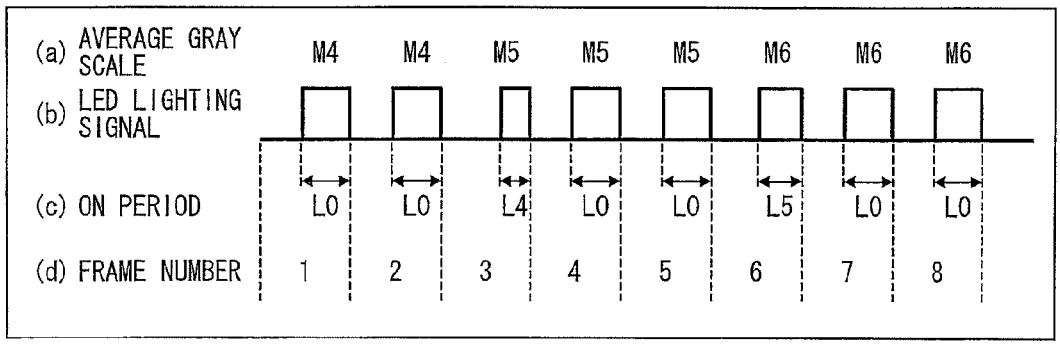
FIG. 8 is an explanation view showing how an on period in an LED lighting signal is changed in a case where there are periods during which a gray scale is kept to a fixed value and periods during which gray scales are being caused.

FIG. 8 is an explanation view showing how the on period in the LED lighting signal is changed in a case where there are periods during which the gray scale is constant and frames in which gray scale transitions are caused.

As shown in (a) and (d) of FIG. 8, an average gray scale in a given area is M4 in frames 1 and 2, M5 in frames 3 through 5, and M6 in frames 6 through 8, so that gray scale transitions are caused in the respective frames 3 and 6. M4, M5, and M6 are different values.

In the frames 1, 2, 4, 5, 7, and 8 in each of which the gray scale is kept constant, no blurring in moving image is caused. Thus, the on period is set to a given length L0. That is, a lighting rate (or non-lighting rate) is kept constant. In contrast, in the frames 3 and 6 in each of which the gray scale transition is caused, the on period is changed to L4 and L5 different from L4, respectively.

The following further describes a concrete time of the off period. Generally, a response speed (response time) of a liquid crystal is defined as a time required, in a case where a difference between brightnesses in two adjacent frames having a gray scale difference is 100%, for a brightness to reach 90% from 10%.

If a frame frequency is 120 Hz, then a one frame cycle is approximately 8.3 ms. Assume in this case, as a worst condition in a case where the display method described with reference to (a) through (g) of FIG. 1 and using no OS driving is performed, that the response speed is 8.3 ms equivalently to the one frame cycle. It is determined that a non-lighting rate in the one frame cycle is 90%. That is, in a frame in which a gray scale transition is caused, the off period of 7.5 ms is provided in a first half part of the one frame cycle, irrespectively of a duration of the gray scale transition. In this case, a driving current for the LEDs 10 are increased so as to make up for insufficiency brightness. This makes the on/off control of the light source easy.

Further, in the display method using no OS driving, the non-lighting rate in each frame may be uniformly set to 90%, irrespectively of a gray scale transition, and the driving current for the LEDs 10 may be increased so as to make up for the insufficiency in brightness. This makes the on/off control of the light source further easy.

However, it is more suitable that the non-lighting rate is changed depending on a change in the response speed. Thus, in the frame in which a gray scale transition for causing a response speed of liquid crystal of 4 ms is caused, it is suitable that the non-lighting rate is set to approximately 50%.

Second Embodiment

Frame Phase Shift

As described earlier, a video signal creation section 2 determines a gray scale in an LCD panel 7 and a brightness of an LED 10 in accordance with image data (a video input signal) that is displayed by an LCD 1. Thereafter, data of the gray scale of the LCD panel 7 thus determined is outputted to an LCD module 3 as an LCD video signal, whereas data of the brightness of the LED 10 thus determined is outputted to a backlight module 4 as an LED video signal.

In order for a gray scale in the LCD panel 7 to be determined, an LCD video signal is created, with use of a buffer memory, by control in a video creation circuit (which is not shown) in the video creation section 2. Thus, there is a time lag between a time when the video creation circuit receives a video input signal and a time when the video creation circuit outputs the LCD video signal. This causes a frame delay. Also, there is a case that the frame delay is caused in a signal process circuit provided upstream of the video creation circuit.

On the other hand, the LED video signal is processed and outputted without a delay. Thus, the LCD video signal and the LED video signal are not identical in terms of a frame. Because of this, it is impossible to perform a suitable image display in this case.

In the present embodiment, the shift between the LCD video signal and the LED video signal is removed by shifting the LED video signal by a degree corresponding to the delay caused in the LCD video signal. This causes phases of the LCD video signal and the LED video signal to be identical with each other. As such, it is possible that the LCD 1 displays an intended image without having any failure. This is described with reference to FIG. 10(*a*) and FIG. 10(*b*). Each of FIG. 10(*a*) and FIG. 10(*b*) is a timing chart showing frame information of each signal.

Figure 10:
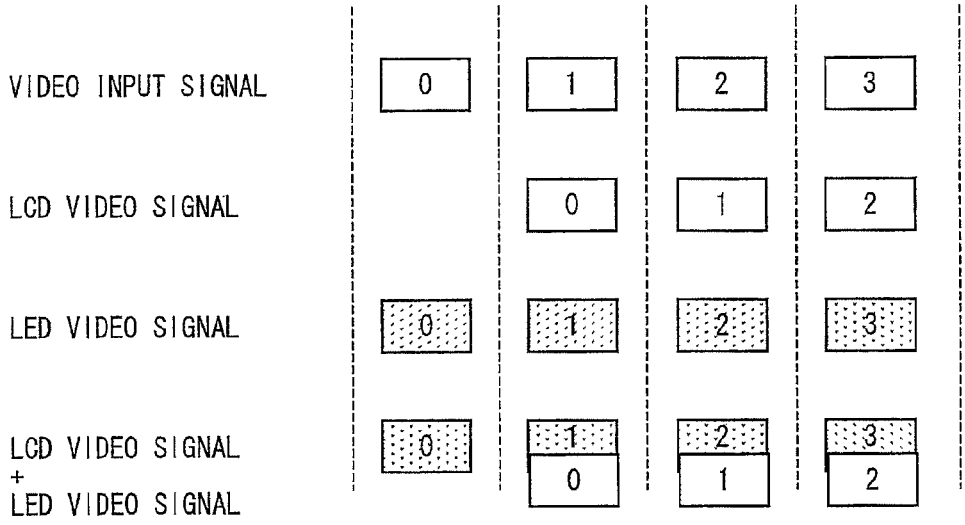
FIG. 10(*a*) is a timing chart showing frame information of each signal in a case where no frame phase shift is caused in the LED video signal.
Figure 10:
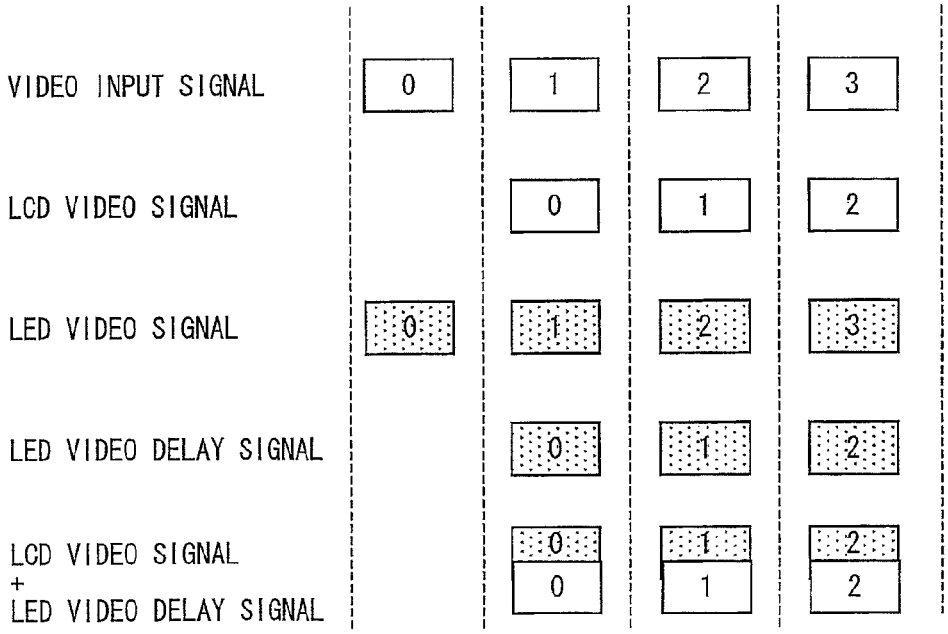

FIG. 10(*a*) is a timing chart obtained in a case where no frame phase shift is caused in the LED video signal. In an example shown in FIG. 10(*a*), a delay of one frame is caused between a time when the video input signal is outputted and a time when the LCD video signal is outputted. On the other hand, the LED video signal is outputted without a delay. Thus, there is a shift of one frame between a driving timing of the LCD video signal and that of the LED video signal.

FIG. 10(*b*) is a timing chart obtained in a case where a frame phase shift is caused in the LED video signal. As shown in FIG. 10(*b*), after the video input signal is supplied to the video creation circuit, the LED video signal is outputted with a delay of the number of frames corresponding to the delay of the LCD video signal. Then, the LED video signal thus delayed is supplied to an LED_T-CON 8 as an LED video delay signal. As a result, there is no lag between the driving timing of the LCD video signal and a driving timing of the LED video delay signal. As such, it is possible that the LCD 1 displays an intended image without having any failure.

The following describes a method for causing a frame phase shift in the LED video signal by a pulse control circuit 12 in an LED driver 9. Specifically, when the video creation section 2 process the video input signal so as to output the LCD video signal, the number of frames of delay caused in the LCD video signal is detected by the video creation circuit. Then, information of the number of frames of delay is supplied to a frame delay setting circuit 21 (frame delay setting section) in the pulse control circuit 12.

As shown in FIG. 6, when a backlight circuit 20 creates an LED lighting signal from the LED video signal supplied from the LED_T-CON 8, the backlight 20 causes a frame shift in the LED lighting signal by use of the information of the number of frames of the delay stored in the frame delay setting circuit 21.

Alternatively, a circuit may be arranged so that (i) the frame delay caused in the LCD video signal is measured, in advance, as a value unique to the video creation section 2, and (ii) the video creation section 2 delays the LED video signal by a degree corresponding to the frame delay caused in the LCD video signal.

Phase Shift

The above describes a case in which the LCD video signal is delayed on frame basis. Besides the frame delay, a slight phase shift may be caused due to a process speed in the video creation circuit. The phase shift is a delay of less than one frame. In order to remove the phase shift, it is suitable to cause a phase shift in the LED video signal and thereby delay the LED video signal. This is described with reference to FIG. 11(*a*) and FIG. 11(*b*). Each of FIG. 11(*a*) and FIG. 11(*b*) is a timing chart showing frame information (phase information) of each signal.

Figure 11:
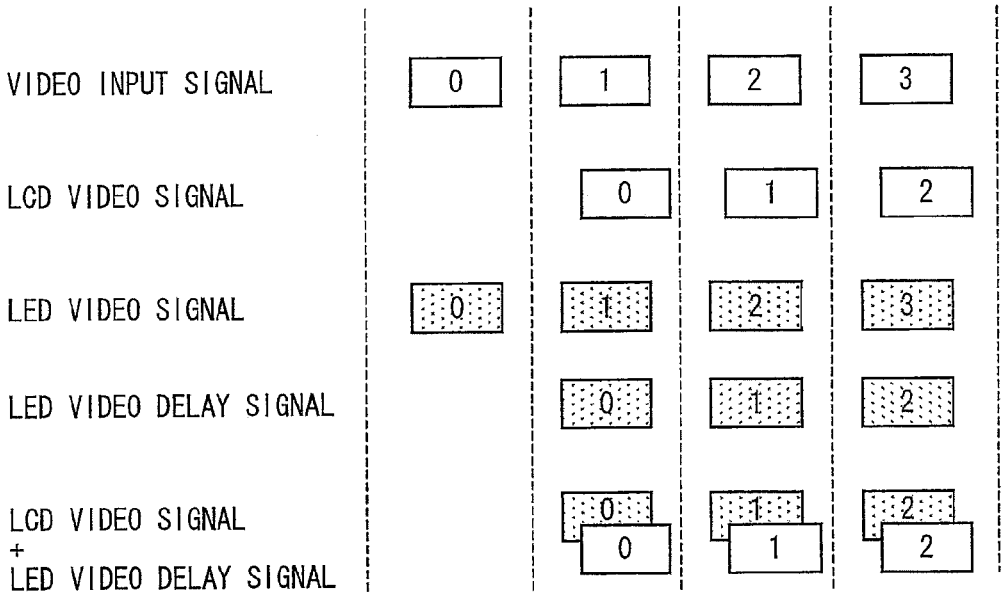
FIG. 11(*a*) is a timing chart showing frame information (phase information) of each signal in a case where no shift in phase is caused in the LED video signal.
Figure 11:
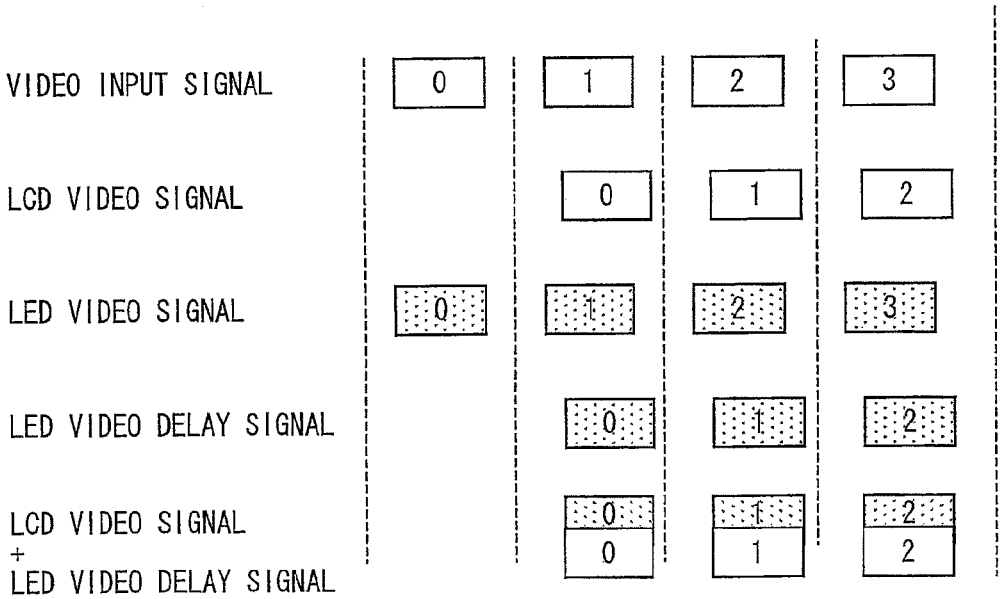
Figure 12:
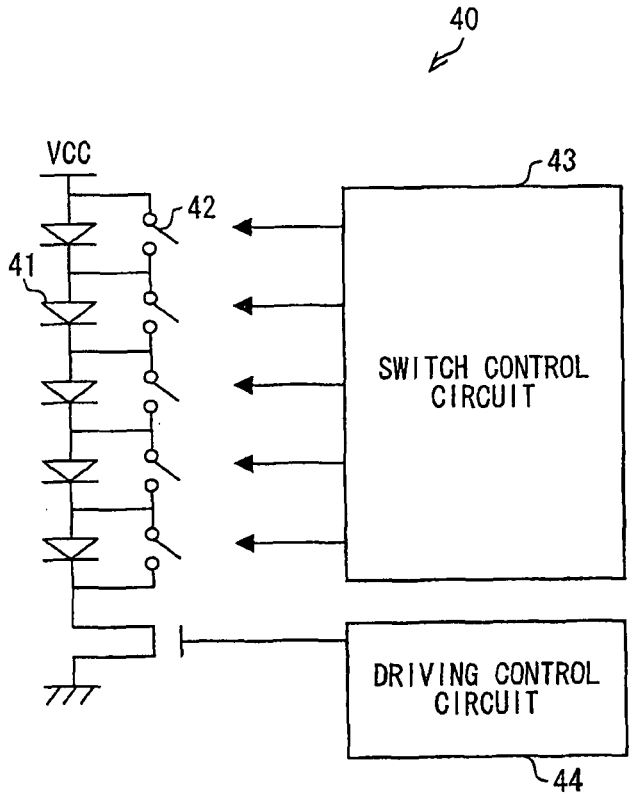
FIG. 12 is a block view showing a conventional LED driving circuit for use in a case where an LED serves as a light source.

FIG. 11(*a*) is a timing chart obtained in a case where no phase shift is caused in the LED video signal. As shown in FIG. 11(*a*), a frame delay and a phase shift are caused between a time when the video creation circuit receives the video input signal and a time when the LCD video signal is outputted. On the other hand, the LED video signal is outputted without a delay. This causes a driving timing of the LCD video signal to be shifted from a driving timing of the LED video signal.

FIG. 11(*b*) is a timing chart obtained in a case where the phase shift is caused in the LED video signal.

As shown in FIG. 11(*b*), after the video input signal is supplied to the video creation circuit, the LED video signal is outputted with a delay corresponding to the number of frames of delay of the LCD video signal and the phase shift caused in the LCD video signal. Then, the LED video signal thus delayed is supplied to the LED_T-CON 8 as an LED video delay signal. This can prevent the driving timing of the LCD video signal from being shifted from a driving timing of the LED video delay signal. As such, it is possible that the LCD 1 displays an intended image without having any failure.

The following describes a method for causing a phase shift in the LED video signal by the pulse control circuit 12 in the LED driver 9. Specifically, when the video creation section 2 process the video input signal so as to output the LCD video signal, the number of delay frames and the phase shift caused in the LCD video signal is detected by the video creation circuit. Then, information of the number of delay frames is supplied to the frame delay setting circuit 21, whereas information of the phase shift is supplied to a phase setting circuit 22 (phase setting section) in the pulse control circuit 12.

As shown in FIG. 6, when the backlight control circuit 20 creates an LED lighting signal from the LED video signal supplied from the LED_T-CON 8, the backlight control circuit 20 causes a frame shift in the LED lighting signal with the use of the information of the number of delay frames stored in the frame delay setting circuit 21 and the information of the phase shift stored in the phase shift setting circuit 22.

In this case, it is required that a degree of phase delay caused in the LED lighting signal be determined in a condition that the response speed of the liquid crystal is slowest. This is because, unless (i) a condition in which a gray scale is stable and (ii) a lighting timing of the backlight are adjusted to each other in the condition that the response speed of the liquid crystal is slowest, blurring in moving image is caused.

The condition in which the response speed of the liquid crystal is slowest is determined, when the LUT value in the OS circuit 11 is determined, based on a result of measurement in conditions that a transition time of each gray scale and a temperature condition are varied in advance.

This enables removing not only the frame delay caused in the LCD video signal but also the slight phase shift. As such, it is possible to remove a disturbance on the image on the LCD 1 caused by the delay of the LCD video signal and thereby to display an intended image without any failure.

The present invention is not limited to the description of each of Embodiments 1 and 2, but may be altered by a skilled person in the art within the scope of the claims. An embodiment derived from a proper combination of technical means disclosed in different embodiments is also encompassed in the technical scope of the present invention.

Further, the display device of the present invention may be a display device further includes a gray scale process section for supplying an emphasis display signal, which is obtained by carrying out a gray scale transition emphasis process to the display signal, to the display driving section during the adjacent frame in which the gray scale transition is caused, the display driving section driving the pixel belonging to the specific area, in accordance with the emphasis display signal.

According to the arrangement, the time data obtaining section finds the average of the response times required for the pixels of the specific area to respond. Subsequently, the gray scale process section supplies, to the display driving section, the emphasis display signal obtained by carrying out the gray transition emphasis process with respect to the display signal. This can increase a brightness of the pixel in the midst of the gray scale transition. As such, it is possible to more effectively prevent an adverse effect that a halfway change in the gray scale transition is reflected in the brightness of each pixel.

With the arrangement, furthermore, it is possible to reduce the response time required for each pixel to respond to the gray scale transition. As such, it is possible to increase a probability that the pixel responds to the gray scale transition within the "off" period of the light source falling within the first half part of the one frame period. This enables removing, with increased certainty, the adverse effect that the halfway change in the gray scale transition is reflected in the brightness of each pixel.

This can cause a further reduction in image blurring caused in a motion image display. As such, it is possible to improve a display quality.

Further, it is preferable that the display device of the present invention is arranged so that the at least one of the respective on and off periods of the light source is determined in such a manner that the longer the average of response times in the specific area is, the longer the length of the off period is.

This can increase the probability that the gray scale transition is completed within the "off" period of the light source falling within the first half part of the one frame period. As such, it is possible to reduce the adverse effect that the halfway change in the gray scale transition is reflected in the brightness of each pixel.

Further, it is preferable that the display device of the present invention is arranged so that, in a frame in which no gray scale transition is caused between the frame and an frame adjacent to the frame, the length of the off period is set to a fixed length, and the light source driving section blinks the light source in accordance with the fixed length of the off period.

A gray scale displayed in the frame in which no gray scale transition is caused is same as in a previous frame. Thus, the pixel is kept to a condition that it completes its response. On this account, like a still image, the frame in which no gray scale transition is caused suffers the problem of moving image blurring.

Thus, in a case of setting the "off" period in the frame in which no gray scale transition is cause, it is not necessary to consider the moving image blurring. Factors which need to be taken into consideration may encompass obtainment of a required brightness and a reduction in power consumption. It is suitable that the "off" period is set to a most suitable constant value in consideration of these factors.

Further, it is preferable that the display device of the present invention is arranged so that the longer the length of the off period determined by the lighting signal control section is, the more the light source driving section increases luminance of the light source during the on period which follows the off period.

With the arrangement, the longer the off period in the one frame is, the shorter the on period, by which the off period is followed, in the same one frame is. In such a circumstance, there is a risk that the brightness of the pixel is insufficient. However, with the light source driving section increasing the luminance of the light source, it is possible to solve such an insufficiency in the brightness of the pixel.

Further, the display device of the present invention may be arranged so that the light source driving section includes a frame delay setting section for (i) setting a frame delay period caused by a signal process up to supply of the display signal to the display driving section, and (ii) shifting a timing of blinking of the light source, on frame basis, in accordance with the frame delay period.

With the arrangement, it is possible that even if the display signal is, prior to being supplied to the display driving section, delayed by the frame delay period (i.e., the delay in each frame) due to a signal process, the frame delay section delays the driving timing of the light source by a same degree as the frame delay period. This can prevent a timing of driving of the pixel and a timing of driving of the light source from being shifted from each other. As such, it is possible to obtain as appropriate an effect brought about by the aforementioned present invention.

The frame delay period may be (i) detected by a circuit by which the display signal to be supplied to the display driving section is subjected to a signal process in advance, and (ii) supplied to the frame delay setting section. Alternatively, the frame delay period may be (i) measured as a constant value unique to the display device, and (ii) stored in the frame delay setting section.

Further, it is preferable that the display device of the present invention is arranged so that the light source driving section includes a phase setting section for (i) setting a phase shift of less than a one frame period caused due to a signal process up to supply of the display signal to the display driving section, and (ii) delaying a timing of blinking of the light source.

With the arrangement, even in a case where the display signal is, prior to being supplied to the display driving section, shifted in phase by a degree less than a one frame period due to the signal processes, it is possible that the phase setting section shifts, by a same degree as the phase shift, a phase of the light source driving signal supplied from the on/off control section to the light source. This can prevent a timing of driving of the pixel and a timing of driving of the light source from being shifted from each other. As such, it is possible to appropriately obtain an effect brought about by the aforementioned present invention.

The phase shift may be (i) detected by the circuit whereby the display signal to be supplied to the display driving section is subjected to a signal process in advance, and (ii) supplied to the frame delay setting section. Alternatively, the phase shift may be (i) measured as a constant value unique to the display device, and (ii) stored in the frame delay setting section.

Further, it is preferable that the display device of the present invention is arranged so that: the specific area is each of a plurality of areas forming the display screen; and the light source in each of the plurality of areas is driven, by the light source driving section, independently from each other.

The present invention is applicable even in a case where the specific area accounts for a one area of the entire display screen. However, in a case of having a plurality of areas in the display screen and including a light sources in each area so as to drive it independently from each other, it is possible to more appropriately reduce, for each area, the adverse effect of the gray scale transition exerted on the display. As such, it is possible to increase an effect of improving the display quality.

It is suitable that the number of areas of the display screen is large and the number of pixels to which one light source corresponds is small, from a perspective of increasing the effect of improving the display quality. However, it is preferable that both the number of the areas and the number of the pixels to which one light source corresponds are optimized in view of a cost, a device weight, a power consumption, etc.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The present invention is applicable to entire display devices each of which causes a pixel forming a display screen to display information, by driving the pixel in accordance with a display signal and modulating, via the pixel, an intensity of light emitted from a light source.

REFERENCE SIGNS LIST

1: liquid crystal display device (LCD)
5*a*: time data obtaining section
6: LCD driver (display driving section)
7: LCD panel
9: LED driver (light source driving section)
10: LED (light source)
11: overshoot (OS) circuit (gray scale processing section)
17: switch control circuit (on/off control circuit)
20: backlight control circuit (lighting signal control section)
21: frame delay setting circuit (frame delay setting section)
22: phase setting circuit (phase setting section.

The invention claimed is:

1. A display method, which (i) causes pixels forming a display screen to display information, by driving the pixels in accordance with a display signal so as to modulate, via each pixel, intensity of light emitted from a light source and (ii) blinks the light source in accordance with a frame frequency, the display method comprising the steps of:

finding an average of a response time required for each pixel belonging to a specific area of the display screen to respond to a gray scale transition between a frame and an adjacent frame following the frame;

determining, based on the average of response times in the specific area, at least one of a length of an off period of the light source in a first half part of a one frame and a length of an on period of the light source in a second half part in the one frame; and after the gray scale transition, driving, at least in the adjacent frame in which the gray scale transition is caused, the light source in accordance with the off period or the on period determined in length.

2. A display method, which (i) causes pixels forming a display screen to display information, by driving the pixels in accordance with a display signal so as to modulate, via each pixel, intensity of light emitted from a light source and (ii) blinks the light source in accordance with a frame frequency, the display method comprising the steps of:

creating, selectively for a pixel out of pixels belonging to a specific area of the display screen in which pixel a gray scale transition is caused between a frame and an adjacent frame following the frame, an emphasis display signal by performing a gray scale transition process with respect to a display signal in the adjacent frame in which the gray scale transition is caused;

finding an average of a response time required for each of the pixels belonging to the specific area of the display screen to respond, in a condition that the gray scale transition process has been selectively carried out to the gray scale transition;

determining at least one of a length of an off period of the light source in a first half part of a one frame and a length of an on period of the light source in a second half part of the one frame; and after the gray scale transition, driving, at least in the adjacent frame in which the gray scale transition is caused, in accordance with the off period or the on period thus determined in length.

3. A display device, comprising:

a light source;

a display driving section configured to cause pixels forming a display screen to display information, by driving the pixels in accordance with a display signal so as to modulate, via each pixel, intensity of light emitted from the light source;

a light source driving section configured to blink the light source in accordance with a frame frequency of the display signal; and a time data obtaining section configured to find an average of a response time required for each pixel of a specific area of the display screen to respond to a gray scale transition caused between a frame and an adjacent frame following the frame, the light source driving section including:

a light signal control section configured to determine, after the gray scale transition, at least one of the following (i) and (ii) in accordance with the average of response times in the specific area, (i) a length of an off period of the light source in a first half part of a one frame and (ii) a length of an on period of the light source in a second half part of the one frame; and an on/off control section configured to blink the light source in accordance with the off period or the on period determined in length.

4. The display device as set forth in claim 3, further comprising a gray scale process section configured to supply an emphasis display signal, which is obtained by carrying out a gray scale transition emphasis process to the display signal, to the display driving section during the adjacent frame in which the gray scale transition is caused, the display driving section driving the pixel belonging to the specific area, in accordance with the emphasis display signal.

5. The display device as set forth in claim 3, wherein the at least one of the respective on and off periods of the light source is determined in such a manner that the longer the average of response times in the specific area is, the longer the length of the off period is.

6. The display device as set forth in claim 3, wherein in a frame in which no gray scale transition is caused between the frame and an frame adjacent to the frame, the length of the off period is set to a length, and the light source driving section blinks the light source in accordance with the fixed length of the off period.

7. The display device as set forth in claim 3, wherein the longer the length of the off period determined by the lighting signal control section is, the more the light source driving section increases luminance of the light source during the on period which follows the off period.

8. The display device as set forth in claim 3, wherein the light source driving section includes a frame delay setting section for (i) setting a frame delay period caused by a signal process up to supply of the display signal to the display driving section, and (ii) shifting a timing of blinking of the light source, on frame basis, in accordance with the frame delay period thus set.

9. The display device as set forth in claim 3, wherein the light source driving section includes a phase setting section configured to (i) set a phase shift of less than a one frame period caused due to a signal process up to supply of the display signal to the display driving section, and (ii) delay a timing of blinking of the light source in accordance with the phase shift thus set.

10. The display device as set forth in claim 3, wherein the specific area is each of a plurality of areas forming the display screen; and the light source in each of the plurality of areas is driven, by the light source driving section, independently from each other.

11. A display device, comprising:

a light source;

a display driving section configured to cause pixels forming a display screen to display information, by driving the pixels in accordance with a display signal so as to modulate, via each pixel, intensity of light emitted from the light source;

a light source driving section configured to blink the light source in accordance with a frame frequency of the display signal;

a gray scale process section configured to create, selectively for a pixel out of pixels belonging to a specific area of the display screen in which pixel a gray scale transition is caused between a frame and an adjacent frame following the frame, an emphasis display signal by performing a gray scale transition process with respect to a display signal in the adjacent frame in which the gray scale transition is caused; and a time data obtaining section configured to find an average of a response time required for each of the pixels belonging to the specific area of the display screen to respond, in a condition that the gray scale transition emphasis process has been selectively carried out to the gray scale transition, the light source driving section including:

a light signal control section configured to determine, after the gray scale transition, at least one of the following (i) and (ii) in accordance with the average of response times in the specific area, (i) a length of an off period of the light source in a first half part of a one frame and (ii) a length of an on period of the light source in a second half part of the one frame; and an on/off control section configured to blink the light source in accordance with the off period or the on period determined in length.

* * * * *